US005510196A

United States Patent [19]

Nakamaru et al.

[11] Patent Number: 5,510,196

[45] Date of Patent: Apr. 23, 1996

[54] CORROSION RESISTANT STEEL SHEETS IMPROVED IN CORROSION RESISTANCE AND OTHER CHARACTERISTICS

[75] Inventors: Hiroki Nakamaru; Tohru Fujimura; Hiroaki Ohnuma; Kazuo Mochizuki; Nobuyuki Morito; Michio Katayama, all of Chiba, Japan

[73] Assignee: Kawasaki Steel Corporation, Japan

[21] Appl. No.: 204,298

[22] PCT Filed: Jul. 9, 1993

[86] PCT No.: PCT/JP93/00956

§ 371 Date: Mar. 8, 1994

§ 102(e) Date: Mar. 8, 1994

[87] PCT Pub. No.: WO94/01602

PCT Pub. Date: Jan. 20, 1994

[30] Foreign Application Priority Data

| | | | |
|---|---|---|---|
| Jul. 10, 1992 | [JP] | Japan | 4-184133 |
| Jul. 10, 1992 | [JP] | Japan | 4-184134 |
| Nov. 11, 1992 | [JP] | Japan | 4-300913 |
| Nov. 11, 1992 | [JP] | Japan | 4-300914 |
| Nov. 11, 1992 | [JP] | Japan | 4-300915 |
| Feb. 9, 1993 | [JP] | Japan | 5-021050 |

[51] Int. Cl.[6] ..... B32B 15/18

[52] U.S. Cl. ..... 428/659; 428/935

[58] Field of Search ..... 428/659, 935; 205/244

[56] References Cited

U.S. PATENT DOCUMENTS

| | | | |
|---|---|---|---|
| 3,822,118 | 7/1974 | Fukuzuka et al. | 428/695 |
| 4,877,494 | 10/1989 | Kanamaru et al. | 205/244 |
| 5,188,905 | 2/1993 | Shindou et al. | 428/659 |
| 5,272,643 | 12/1993 | Hasegawa et al. | 205/244 |

FOREIGN PATENT DOCUMENTS

| | | |
|---|---|---|
| 64-55398 | 3/1989 | Japan . |
| 1-191797 | 8/1989 | Japan . |
| 3-31495 | 2/1991 | Japan . |
| 3-120393 | 5/1991 | Japan . |
| 5-9779 | 1/1993 | Japan . |

*Primary Examiner*—John Zimmerman
*Attorney, Agent, or Firm*—Austin R. Miller

[57] ABSTRACT

Zn—Cr alloy plated steel sheets have excellent corrosion resistance. It has now been found that the phase structures of Zn—Cr alloy platings are such that they comprise yet to be known phases ηx, δx and Γx. Furthermore, these phases when taken either singly or with two or more phases being mixed together, exhibit the following characteristics (1)–(6). The characteristics of the respective phases are also identified below.

| | |
|---|---|
| (1) ηx | Resistance to cosmetic corrosion |
| (2) Γx | Formability |
| (3) ηx + δx | Chipping resistance |
| (4) ηx + Γx | Corrosion resistance in the as-formed state |
| (5) δx + Γx | Water resistant secondary adherence of coating |
| (6) ηx + δx + Γx | Perforation corrosion resistance |

ηx: Hexagonal crystal
a = 2.66–2.74 Å
c = 4.61–4.95 Å

δx: Hexagonal crystal
a = 2.72–2.78 Å
c = 4.43–4.60 Å

Γx: Cubic crystal
a = 3.00–3.06 Å

11 Claims, 10 Drawing Sheets

(1) $\eta_x$ SOLID SOLUTION OF Cr IN THE $\eta x$ PHASE OF Zn

CRYSTAL SYSTEM: HEXAGONAL a = 2.66 ~ 2.74Å c = 4.61 ~ 4.95Å

(2) $\delta_x$ PHASE NOT FOUND IN THE EQUILIBRIUM PHASE DIAGRAM

CRYSTAL SYSTEM: HEXAGONAL a = 2.72 ~ 2.78Å c = 4.43 ~ 4.60Å

(3) $\Gamma_x$

CRYSTAL SYSTEM: CUBIC a = 3.00 ~ 3.06Å

INVENTIVE SAMPLES

○ CORROSION RESISTANCE OF FLAT PLATE IN BARE STATE

◍ CORROSION RESISTANCE IN THE BARE STATE AFTER FORMING BY HAT DRAWING

COMPARATIVE SAMPLES

△ CORROSION RESISTANCE OF FLAT PLATE IN BARE STATE

◭ CORROSION RESISTANCE IN THE BARE STATE AFTER FORMING BY HAT DRAWING

CORROSION RESISTANT STEEL SHEETS IMPROVED IN CORROSION RESISTANCE AND OTHER CHARACTERISTICS

TECHNICAL FIELD

The invention of the subject application relates to corrosion resistant steel sheets that satisfy the various properties required of the corrosion resistant steel sheets for use on automobiles, etc., which include not only high corrosion resistance but also either one of high resistance to cosmetic corrosion, good formability, high chipping resistance, high corrosion resistance in the as-formed state, strong water resistant secondary adherence of coating and high perforation corrosion resistance.

BACKGROUND ART

Automotive corrosion resistant steel sheets commercially used today include electrogalvanized steel sheets, steel sheets with electroplated Zn—Ni alloys, steel sheets with electroplated Zn—Fe alloys, hot-dip galvannealed steel sheets and various other types, all of which are Zn base plated steel sheets. These make use of the self-sacrificial corrosion preventing action of Zn for steels. The most straightforward way to improve corrosion resistance is by increasing the coating weight of plating (hereunder referred to as "coating weight") but the increase in coating weight is accompanied by deterioration in formability, weldability and other quality factors.

Attempts have therefore been made to alloy Zn with other elements so that smaller coating weights than that of pure Zn will suffice for providing comparable degree of corrosion resistance. Potential effects of alloying include, for example, bringing the corrosion potential of the alloy even closer to steel so that the corrosion rate of the plating layer per se is allowed down, and stabilizing the corrosion product. However, the contribution of alloying to the improvement in corrosion resistance has been still unsatisfactory in the conventional Zn base alloy plated steel sheets. Under the circumstances, attempts have been made in recent years to add Cr as an alloying element to the Zn base plating layer. Examples of such attempts have been proposed in Japanese Patent Application (kokai) Nos. Hei 1-191797, 3-120393, etc. It is true that as far as the corrosion resistance in the bare state is concerned, increasing the percent Cr content contributes to the formation of a Zn—Cr alloy plating that exhibits better corrosion resistance than the conventional Zn base alloy plating.

As an example, a salt spray test was conducted in accordance with JIS Z 2371 and the number of days to 2% red rust development was checked. The results are shown in FIG. 1. Motorcar bodies are normally formed before use, so the test specimens were those which had been subjected to 17% stretch. In the following description, values of coating weight are sometimes indicated with the symbol for unit of its measure ($g/m^2$) being omitted. For example, a coating weight of 30 $g/m^2$ may be indicated as coating weight 30. In FIG. 1, EG 30 designates a commercial electrogalvanized steel sheet with coating weight 30; GA 60 is a commercial hot-dip galvannealed steel sheet with coating weight 60; and Zn—Ni 30 designates a commercial Zn—Ni alloy plated steel sheet with coating weight 30 and 13% Ni content. For all Zn—Cr specimens, the coating weight of the plating was 20 $g/m^2$.

One can see from FIG. 1 that the corrosion resistance of the Zn—Cr alloy plated steel sheet in the bare state improves almost linearly with the increase in the percent Cr content of the alloy. It can also be seen that even with coating weight 20, the samples have better corrosion resistance in the bare state than EG 30 and GA 60 of higher coating weight if Cr/(Cr+Zn) is 2 wt % or more. Thus, the Zn—Cr alloy plated steel sheet exhibits better corrosion resistance in the bare state and this would be because in a corrosive environment, the surface oxide film of Cr suppresses the dissolved oxygen reducing reaction by a marked degree to reduce the corrosion current density, or retard the corrosion rate.

The experimental result under consideration is that of a test assuming corrosion that occurs principally in a site such as where the inner surface of an automotive body is electrodeposited with so small coatings that the surface is partially left in the bare state. Speaking of the corrosion resistance of various surface treated steel sheets, it is largely dependent on the nature of corrosive environment and the ranking in corrosion resistance can vary as a result of the change in the environment. In recent years, as the sophistication of car models has become an industrial trend, there is a growing rigor in the demand for the corrosion resistance against rust that will develop on the exterior surfaces of automotive bodies. Cosmetic corrosion progresses under coatings starting at the damaged site of the coating due primarily to such factors as the throwing of pebbles by the wheel of a running vehicle and it will impair the vehicle's external appearance in the form of red rust, blistering of coatings or the like.

As already mentioned, the corrosion resistance of the Zn—Cr alloy plated steel sheet improves linearly with the increase in the percent Cr content in the corrosive environment on the inner surface of an automotive body. In contrast, the resistance against rusting on the exterior surface of an automotive body will not necessarily improve in response to the increase in the percent Cr content but may occasionally deteriorate in response to the increase in the percent Cr content. Hence, the Zn—Cr alloy plated steel sheet has had the problem that compared to other Zn base plated steel sheets, its corrosion resistance in the bare state is good but the resistance against rusting on the exterior surface of an automotive body (cosmetic corrosion) is poor.

Therefore, the first object of the present invention is to provide a corrosion resistant steel sheet that is improved not only in corrosion resistance but also in resistance against cosmetic corrosion.

While the improvement in corrosion resistance by alloying has been described above, it should of course be understood the coating weight also presents a significant effect.

As an example, the result of the test assuming corrosion that occurs in the case of use on the exterior surface of an automotive body is shown in FIG. 2. Since the exterior surface of an automotive body is usually provided with coatings, corrosion starts at the damaged site of the coating due to such factors as the throwing of pebbles by the wheel of an automobile. Corrosion resistance tests on motorcar bodies can most reliably be performed with actual car models. However, on account of the longevity of time that passes before the result of evaluation becomes available and due to the cost problem, the methods commonly employed include the exposure to atmospheric air of coated test specimens that in which specified scribes have been made, and the use of a cyclic corrosion tester that creates artificially an accelerated corrosion environment by the appropriate combination of salt spray with drying and humidifying cycles. The data in FIG. 2 show the results of measurement for the blister width of coatings that was conducted after performing a cyclic corrosion test (for the test cycles, see FIG. 3) for 2 months on steel samples that had been subjected to chemical conversion treatment with zinc phosphate and 3-coat application, followed by scribing to the substrate steel.

Indicated by "pure Zn" in FIG. 2 is a galvanized steel sheet that was prepared by an electrogalvanization technique in the usual manner (which is hereunder designated as "EG"). "GA" refers to a commercial hot-dip galvannealed steel sheet. "Zn-13 wt % Ni" refers to a commercial Zn—Ni alloy plated steel sheet with 13 wt % Ni content (which is hereunder designated as "Zn—Ni"). "Zn-13 wt % Cr" refers to a Zn—Cr alloy plated steel sheet with 13 wt % Cr content (which is hereunder referred to as "Zn—Cr"). As one can see from FIG. 2, all alloy plated steel sheets tested were improved in corrosion resistance compared to EG with the same level of coating weight but the alloying effect was the greatest in the Zn—Cr alloy plated steel sheet.

However, the coating weight also presents a significant effect and, hence, the Zn—Cr alloy plated steel sample with coating weight 10 is superior to EG with coating weight 20 but inferior to EG or Zn—Ni alloy plated steel sample with coating weight 30. Further, in order to insure comparable corrosion resistance to that of the hot-dip galvannealed steel sheet with a coating weight of 60 g/m$^2$ which is domestically used today in the largest quantity, even the Zn—Cr alloyed plated steel requires 30 g/m$^2$. Thus, any plating species provides better corrosion resistance as the coating weight increases and the change is particularly marked when the coating weight is in the range from 10 to 30 g/m$^2$. However, especially in the case of the Zn—Cr alloy plated steel sheet, the formability deteriorates sharply in response to the increase in coating weight and, hence, it has suffered from the problem of low practical feasibility due to poor formability in spite of its high corrosion resistance.

Therefore, the second object of the present invention is to provide a corrosion resistant steel sheet that is improved not only in corrosion resistance but also in formability.

As already pointed out, the recent industrial trend for the sophistication of car models has created a growing rigor in the demand for the corrosion resistance against rust that will develop on the exterior surfaces of automotive bodies. Cosmetic corrosion progresses under coatings starting at the damaged site of the coating due primarily to such factors as the throwing of pebbles by the wheel of a running vehicle (which are hereunder collectively designated as "chipping") and it will impair the vehicle's external appearance in the form of red rust, blistering of coatings or the like. Therefore, endurance against chipping which triggers corrosion is an important factor to be considered.

In a corrosive environment on the inner surface, the corrosion resistance of the Zn—Cr alloy plated steel sheet improves linearly in response to the increase in the percent Cr content. However, the resistance to chipping does not improve necessarily in response to the increase in the percent Cr content; to the contrary, the chipping resistance tends to deteriorate in response to the increasing percent Cr content. Hence, the Zn—Cr alloy plated steel sheet has had the problem that compared to other Zn base plated steel sheets, its corrosion resistance in the bare state is good but the chipping resistance is poor.

Therefore, the third object of the present invention is to provide a corrosion resistant steel sheet that is improved in chipping resistance.

Further, if one wants to form the Zn—Cr plating and yet achieve as strong corrosion resistance as before it is formed, he may increase either the Cr content or the coating weight. However, the approach of increasing the Cr content is limited in effectiveness since if it exceeds 30 wt %, the adhesion of the plating perse will deteriorate. The approach of increasing the coating weight is also inappropriate since this will cause the same type of deterioration in quality as in the aforementioned case of the prior art Zn plating.

Therefore, the fourth object of the present invention is to provide a corrosion resistant steel sheet that is improved not only in corrosion resistance before forming but also in corrosion resistance after forming.

In the current production line of automotive bodies, paints are applied over platings and, hence, the adhesion of coatings is also an important factor. An example of this practice is the chemical conversion treatment with zinc phosphate, followed by three-coat application comprising cationic electrodeposition coating, intermediate coating and top coating. To evaluate the adhesion of the applied coats, the sample formed by this method was sealed on both the back surface and the end faces, immersed in pure water at 50° C. for 10 days, recovered from the water and immediately subjected to a cross cut adhesion test. The result of visual check on this test sample is shown in FIG. 4. For comparison, the results on conventional Zn platings are also shown in FIG. 4. As one can see from the figure, the Zn—Cr alloy plating is inferior to the conventional Zn plating in terms of water resistant secondary adherence of coating.

Therefore, the fifth object of the present invention is to provide a corrosion resistant steel sheet that is improved not only in corrosion resistance but also in water resistant secondary adherence of coating.

The foregoing experimental results relate to corrosion resistance in the bare state. In the current production line of automotive bodies, the chemical conversion treatment is followed by cationic electrodeposition coating and, on the exterior surfaces of car bodies, intermediate and top coatings are applied to produce a total of three coats; however, the inner surfaces are generally used with the electrodeposited coat alone. On the inner surfaces, a certain type of corrosion may occasionally become a problem in that corrosion as it started from areas of low throwing power in electrodeposition coating, such as those around mating surfaces including hem-flange Of door, progress under the coating to eventually result in perforation. If this problem is a real concern, the corrosion resistance of the plating layer perse is not sufficient and a total corrosion inhibiting schedule is required taking into account the combination with the coatings. As already mentioned, the corrosion resistance of the Zn—Cr alloy plated steel sheet in the bare state improves linearly with the increase in the percent Cr content; however, after electrodeposition coating, perforation corrosion tends to progress as a function of the increase in the percent Cr content. Hence, the Zn—Cr alloy plated steel sheet which has better corrosion resistance in the bare state than other Zn base plated steel sheets has suffered from the problem of lower resistance to perforation.

Therefore, the sixth object of the present invention is to provide a corrosion resistant steel sheet that has improved perforation corrosion resistance.

DISCLOSURE OF INVENTION

According to the first aspect of the present invention, there is provided a corrosion resistant steel sheet having improved resistances to corrosion and cosmetic corrosion that is treated with a Zn—Cr alloy plating which is an alloy consisting of Zn and Cr as formed by electrodeposition and which is substantially solely composed of a phase having such a structure that the crystal system is hexagonal and that lattice constants are a=2.66–2.74 Å and c=4.61–4.95 Å.

According to the second aspect of the present invention, there is provided a corrosion resistant steel sheet having improved corrosion resistance and formability that is treated with a Zn—Cr alloy plating which is an alloy consisting of Zn and Cr as formed by electrodeposition and which is substantially solely composed of a phase having such a structure that the crystal system is cubic and that a lattice constant is a=3.00–3.06 Å.

According to the third aspect of the present invention, there is provided a corrosion resistant steel sheet having improved resistances to corrosion and chipping that is treated with a Zn—Cr alloy plating which is an alloy consisting of Zn and Cr as formed by electrodeposition and which is substantially composed of a phase having such a structure that the crystal system is hexagonal and that lattice constants are a=2.66–2.74 Å and c=4.61–4.95 Å, as well as a phase having such a structure that the crystal system is hexagonal and that lattice constants are a=2.72–2.78 Å and c=4.43–4.60 Å.

According to the fourth aspect of the present invention, there is provided a corrosion resistant steel sheet having improved corrosion resistance both before and after forming that is treated with a Zn—Cr alloy plating which is an alloy consisting of Zn and Cr as formed by electrodeposition and which is substantially composed of a phase having such a structure that the crystal system is hexagonal and that lattice constants are a=2.66–2.74 Å and c=4.61–4.95 Å, as well as a phase having such a structure that the crystal system is cubic and that a lattice constant is a=3.00–3.06 Å.

According to the fifth aspect of the present invention, there is provided a corrosion resistant steel sheet having improved corrosion resistance and water resistant secondary adherence of coating that is treated with a Zn—Cr alloy plating which is an alloy consisting of Zn and Cr as formed by electrodeposition and which is substantially composed of a phase having such a structure that the crystal system is hexagonal and that lattice constants are a=2.72–2.78 Å and c=4.43–4.60 Å, as well as a phase having such a structure that the crystal system is cubic and that a lattice constant is a=3.00–3.06 Å.

According to the sixth aspect of the present invention, there is provided a corrosion resistant steel sheet having improved resistances to corrosion and perforation corrosion that is treated with a Zn—Cr alloy plating which is an alloy consisting of Zn and Cr as formed by electrodeposition and which is substantially composed of a phase having such a structure that the crystal system is hexagonal and that lattice constants are a=2.66–2.74 Å and c=4.61–4.95 Å, and a phase having such a structure that the crystal system is hexagonal and that lattice constants are a=2.72–2.78 Å and c=4.43–4.60 Å, as well as a phase having such a structure that the crystal system is cubic and that a lattice constant is a=3.00–3.06 Å.

BEST MODE FOR CARRYING OUT THE INVENTION

Figure 1:
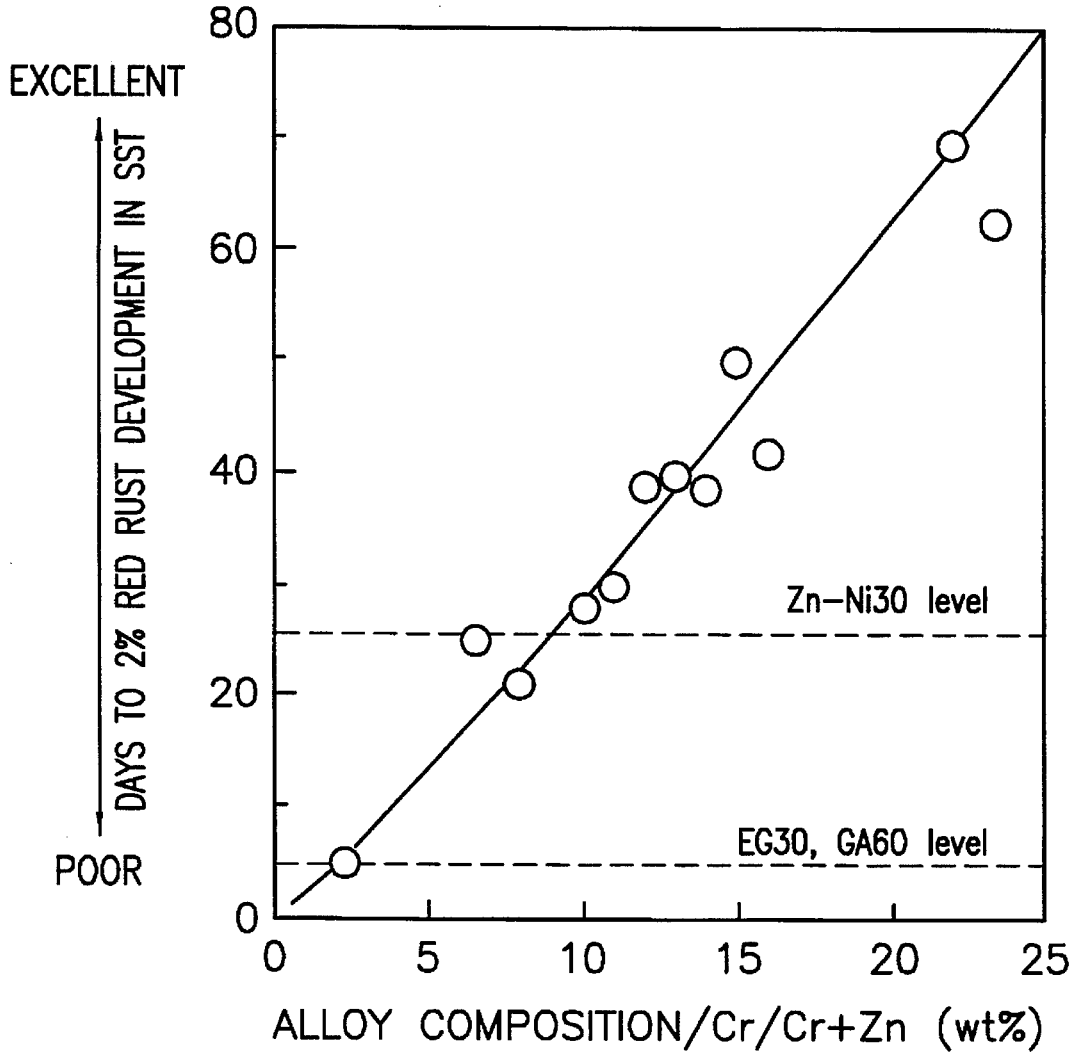
FIG. 1 is a diagram showing the relationship between the corrosion resistance of a Zn—Cr alloy plated steel sheet in the bare state and the alloy composition.
Figure 2:
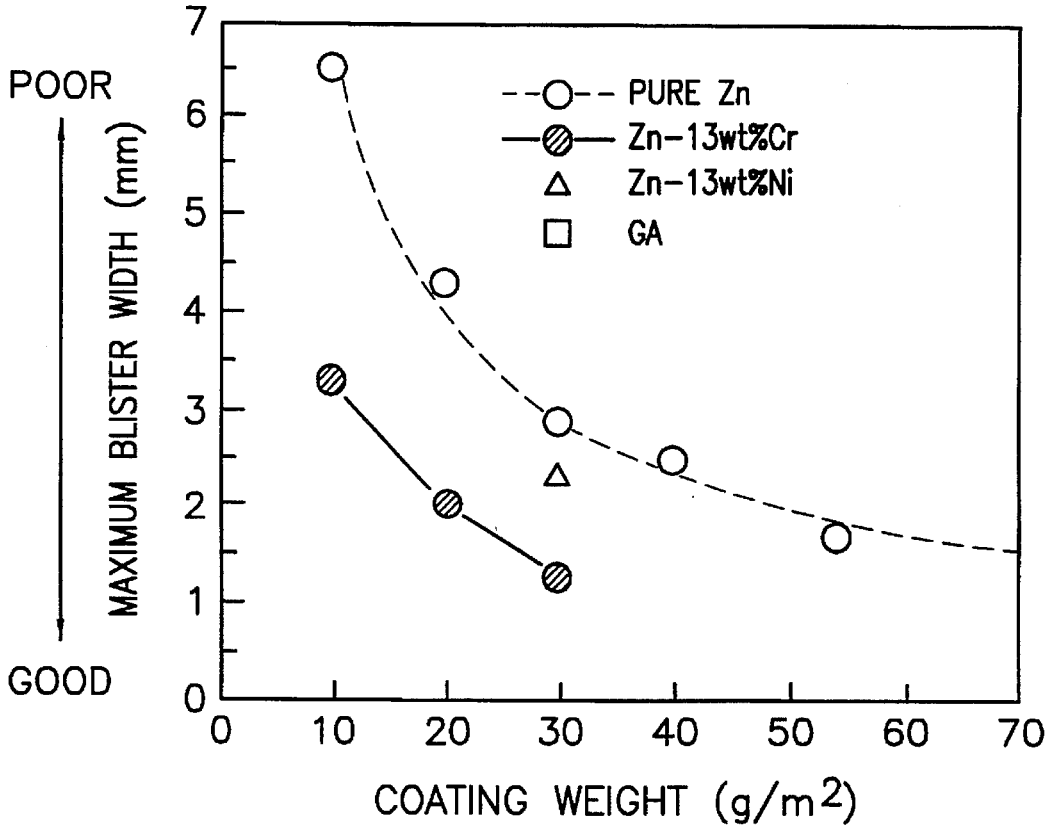
FIG. 2 is a diagram showing the relationship between maximum blister width of coatings from the scribe on various kinds of surface treated steel sheets and the coating weight of the platings.

The present invention is described below in greater detail.

The present invention discloses corrosion resistant steel sheets that are treated with Zn—Cr alloy plating and it is characterized by the finding that among Zn—Cr alloy platings, those which are composed of phases of ηx, δx and Γx, taken either singly or in combination of two or more of these phases, exhibit not only high corrosion resistance but also good performance in the various other characteristics that are described below. In this regard, the present invention embraces six aspects. For better understanding, the inventions of such six aspects are summarized collectively in the following table and the respective aspects will be discussed individually.

| Aspect | Claim | Zn—Cr alloy phase | Characteristics |
|---|---|---|---|
| First | 1 | ηx | Resistance to cosmetic corrosion |
| Second | 2 | Γx | Formability |
| Third | 3 | ηx + δx | Chipping resistance |
| Fourth | 4 | ηx + Γx | Corrosion resistance in the as-formed state |
| Fifth | 5 | δx + Γx | Water resistant |

-continued

| Aspect | Claim | Zn—Cr alloy phase | Characteristics |
|---|---|---|---|
| | | | secondary adherence of coating |
| Sixth | 6 | ηx + δx + Γx | Perforation corrosion resistance |

(A) First aspect ( ηx phase, resistance to cosmetic corrosion).

Concerning conventional Zn—Cr binary alloys that form intermetallic compounds which are stable at thermal equilibrium state, there has been reported a phase (θ phase) having such a structure that the crystal system is hexagonal and that lattice constants are a=12.89 Å and c=30.5 Å. See, for example, the equilibrium phase diagram shown in M. Hansen, Constitution of binary alloys, p. 571, McGRAW-HILL. The formula of the θ phase is not completely clear but it is to lie within the range of Cr/(Cr+Zn)=3.8–7 wt %. Other intermetallic compounds have not been reported. Thus, as regards Zn—Cr binary alloys at thermal equilibrium state, only three phases, (1) η the phase of Zn, (2) θ phase, and (3) Cr phase, are held to exist.

In this connection, it should be noted that alloys that are generally formed by electrodeposition will not always produce a thermodynamically stable phase but a non-equilibrium phase may in some cases be produced. It should further be mentioned that various phases will develop depending on manufacturing conditions such as the formula of a plating bath, conditions for electrolysis. Hence, given the same alloy formula, different phase structures may in some cases occur. The present inventors have the opinion that there is correlation between the resistance to cosmetic corrosion of a car body and the phase structure. Hence the inventors contemplated that plating layers having improved resistance to cosmetic corrosion would be produced by specifying the phase structures using effectively the characteristic features of the electrodeposition method.

As for the Zn—Cr binary alloys, there have been no reported cases of intermetallic compounds of such non-equilibrium phase, still less the data of JCPDS cards. Under the circumstances, the present inventors investigated in detail the phase structures of Zn—Cr alloys that were produced by the electrodeposition method. The technique was by electrodepositing alloys with the compositional range of Cr/(Cr+Zn)=0–30 wt % under various manufacturing conditions and then examining the changes in the spacing of lattice planes by X-ray diffractometry. Hereinafter, the amount expressed by Cr/(Cr+Zn) in wt % shall be designated as the percent Cr content. In the case where the percent Cr content is 0 wt %, namely, in the case of pure Zn, the η phase occurs whose crystal system is hexagonal and which has lattice constants of a=2.665 Å and c=4.947 Å.

However, as the percent Cr content was increased gradually, namely, by forming a solid solution of Cr in the phase, the crystal, which remained in the same system, extended in the direction of a axis but contracted in the direction of c axis; this observation was obtained from the changes in the spacing of lattice planes on the basis of the X-ray diffraction data. It has become clear that up to the point where the percent Cr content is 5 wt % or so, such formation of a solid solution of Cr in the η phase yields only a phase that is characterized by the continuous change in lattice constants. The present inventors will define this phase as ηx.

Figure 5:
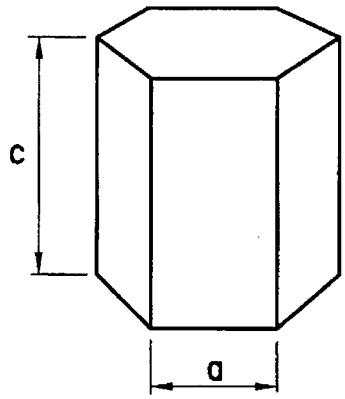
FIG. 5 is a set of diagrams illustrating the phase structures of an electrodeposited Zn—Cr alloy: (1) ηx, (2) δx, and (3) Γx.
Figure 5:
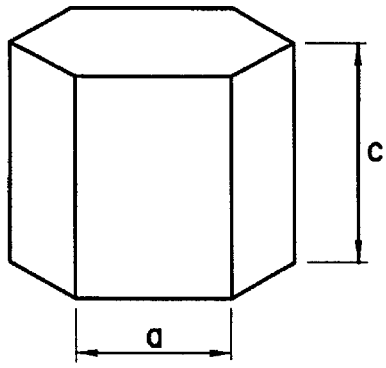
Figure 5:
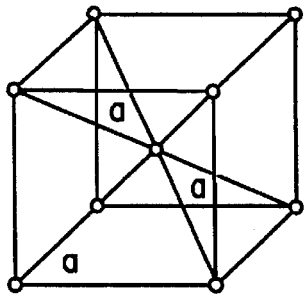
Figure 6:
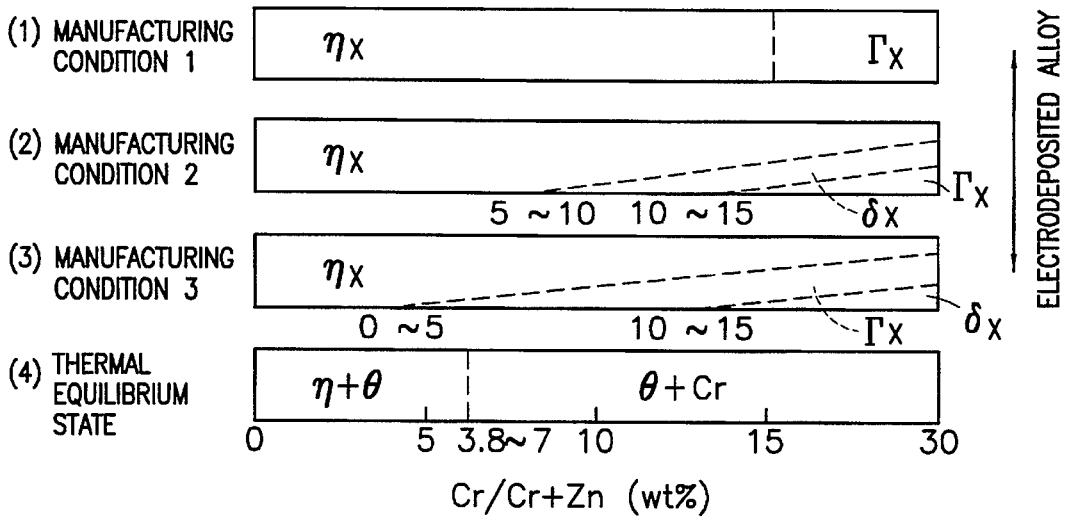
FIG. 6 is a set of diagrams showing the formula-dependent changes (1)–(3) in phase structure of electrodeposited Zn—Cr binary alloys that were produced under conditions 1–3, as well as the phase structure at thermal equilibrium state (4).

As the percent Cr content is further increased, peaks in X-ray diffraction pattern will appear that can be ascribed to phases obviously different from ηx. However, the percent Cr content at which those peaks appear differs with the manufacturing conditions. By repeated calculations with the assumption of crystal system and lattice constants and by comparing the results with the spacing of lattice planes as determined from X-ray diffraction pattern, it has become clear that in addition to ηx, there also exist a phase having such a structure that the crystal system is hexagonal and that lattice constants are a=2.72–2.78 Å and c=4.43–4.60 Å (which phase is defined as the δx phase), as well as a phase having such a structure that the crystal system is cubic and that a lattice constant is a=3.00–3.06 (which phase is defined as Γx). These results are shown in FIG. 5. The percent Cr content at which the ηx, δx and Γx phases develop differs with the manufacturing conditions and, hence, defies generalization; instead, the results obtained under several manufacturing conditions are shown in FIG. 6 as examples. As discussed above, the phase structures of electrodeposited Zn—Cr alloys would be solely composed of three phases.

In the next place, the present inventors produced Zn—Cr alloy plated steel sheets under various conditions and examined the relationship between their resistance to cosmetic corrosion of a car body and the alloy composition. To their surprise, it became clear that the resistance to cosmetic corrosion of the Zn—Cr alloy plated steel sheet that was substantially solely composed of the ηx phase was outstandingly superior to that of Zn—Cr alloy plated steel sheets containing the δx or Γx phase.

Thus, it has become clear that by applying a Zn—Cr alloy plating which is an alloy consisting of Zn and Cr as formed by electrodeposition and which is substantially solely composed of a phase having such a structure that the crystal system is hexagonal and that lattice constants are a=2.66–2.74 Å and c=4.61–4.95 Å, one can obtain a Zn—Cr alloy plated steel sheet having improved resistance to cosmetic corrosion of a car body.

As already mentioned above, the range of percent Cr content for producing the Zn—Cr alloy plating that is substantially solely composed of the ηx phase defies generalized definition since it varies with the manufacturing process but it is desirably 1–15 wt %. This is because below 1 wt % only insufficient corrosion resistance results whereas above 15 wt % the δx or Γx phase will develop, thus making it difficult to form a plating layer that is substantially solely composed of the ηx phase. The coating weight of the plating is desirably 10–40 g/m$^2$ because below 10 g/m$^2$, only insufficient corrosion resistance results whereas above 40 g/m$^2$ there is no cost merit.

The manufacturing conditions for obtaining the Zn—Cr alloy plating of the present invention may be exemplified, but in no way limited, by electrodeposition from a sulfate bath which contains zinc sulfate and chromium sulfate as primary agents, sodium sulfate as an electroconductive aid, boric acid or various other organic acids as pH buffers, as well as various surfactants.

Other conditions such as the pH of the bath, its temperature, the liquid flow rate and the current density for electrolysis are selected as appropriate for producing a desired phase structure. Since all of these conditions are influential on the phase structure, the alloy plating that is substantially solely composed of ηx is obtained only in the case where those conditions are combined in an appropriate way.

It should be mentioned that when performing electroplating in practice on an industrial scale, there can be the case where phases other than the ηx phase will develop inevitably even under optimal plating conditions; however, contamination by small amounts of extraneous phases is in no way excluded as long as they are within the range over which the plating proves to be as effective as the plating that is composed of the pure ηx phase, and it should be understood that such range may be included in the definition of the expression "substantially composed of the ηx phase" as used in the present invention.

The advantage of the first aspect of the present invention is described below on the basis of an example.

EXAMPLE 1

Figure 3:
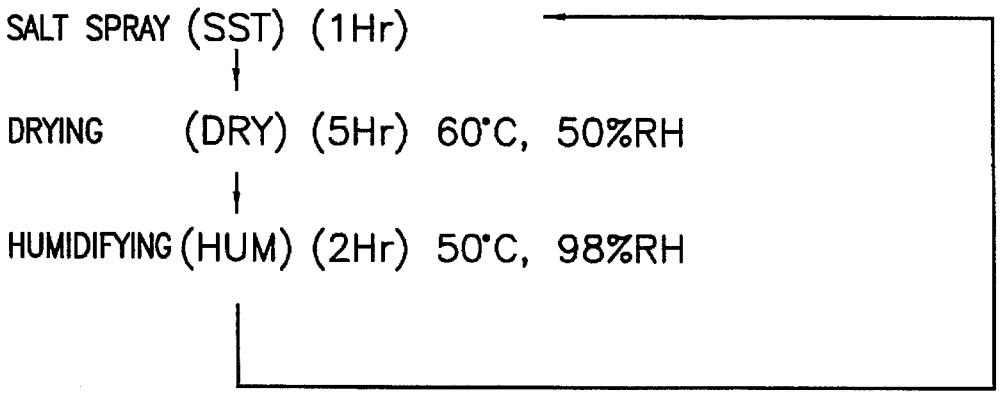
FIG. 3 is a flow diagram of a cyclic corrosion test.
Figure 4:
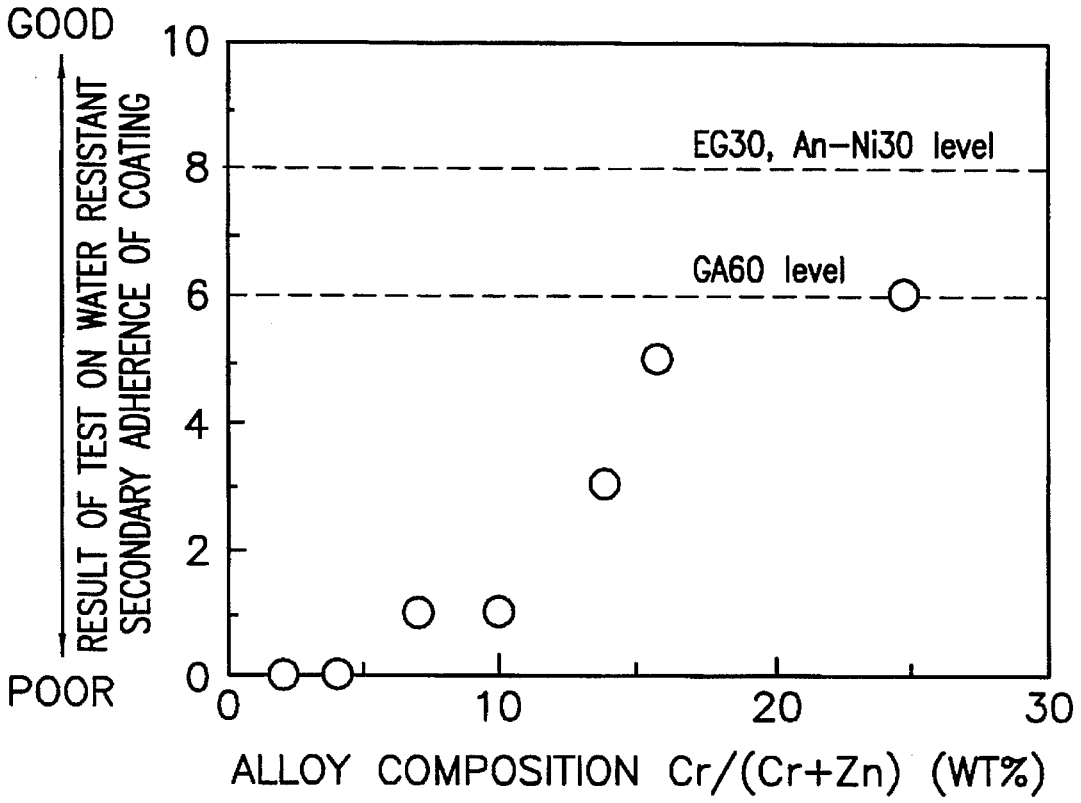
FIG. 4 is a diagram showing the result of a test conducted on the Zn—Cr alloy plated steel sheet to evaluate its water resistant secondary adherence of coating.

Table 1 lists the manufacturing conditions for inventive samples and comparative samples, the coating weight of the plating, percent Cr content and the phase structure. In all cases, SPCD (cold rolled steel sheet) with a sheet thickness of 0.7 mm was used as substrate, which was degreased and pickled in the usual manner, followed by plating to prepare samples. Each sample of the invention was substantially solely composed of the ηx phase whereas the comparative samples obviously contained the δx or Γx phase. It should, however, be noted that those samples which contained up to about 1% of the δx phase and/or the Γx phase were considered to be substantially solely composed of the ηx phase. Using the samples listed in Table 1, resistance to cosmetic corrosion of a car body was evaluated. The evaluation of resistance to cosmetic corrosion of a car body was conducted by the following procedure: a test specimen of 150 mm×70 mm was subjected to the chemical conversion treatment with zinc phosphate in the same manner as it was effected on ordinary automotive cold rolled steel sheets; thereafter, three-coat application was performed consisting of cationic electrodeposition coating (to give a film thickness of 20 μm), intermediate coating (40 μm) and top coating (40 μm); the sample was scribed to the substrate with a cutter knife and the sample was exposed to a corrosive environment for one month using a cyclic corrosion tester (for the test cycles, see FIG. 3); subsequently, the blister width of coatings from the scribe was measured.

Figure 7:
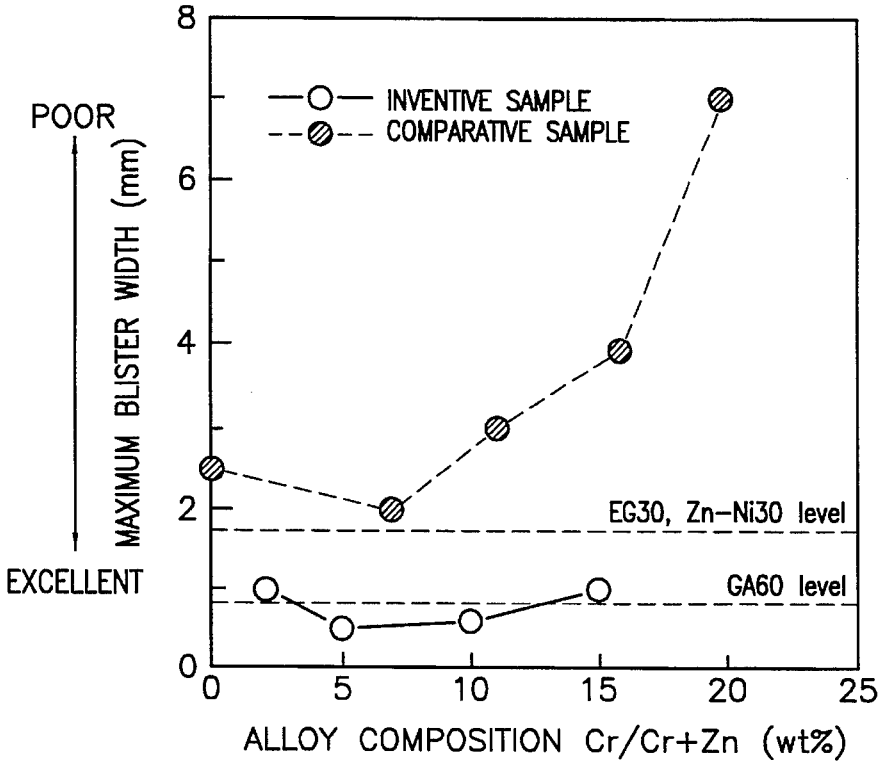
FIG. 7 is a diagram showing the relationship between the resistance of the Zn—Cr alloy plated steel sheet to cosmetic corrosion of an automotive body and the alloy composition.

The results of these measurements are shown in FIG. 7. As one can see from FIG. 7, the Zn—Cr alloy plated steel sheets that satisfied the conditions of the present invention had resistance to cosmetic corrosion of a car body that was better than that of EG 30 (EG with coating weight of 30 g/m$^2$) and Zn—Ni 30 (Zn—Ni alloy plated steel sheet with coating weight of 30 g/m$^2$) and which was comparable to that of GA 30 (GA with coating weight of 60 g/m2). In contrast, comparative sample 1 which was solely composed of the η phase was not satisfactory in corrosion resistance since it did not contain Cr. Comparative samples 2 and so forth were of such a phase structure that they substantially contained the δx phase and/or the Γx phase and, hence, their resistance to cosmetic corrosion deteriorated in response to the increase in the percent Cr content.

TABLE 1

Manufacturing Conditions for Samples of the Invention and Comparative Samples, Coating Weight of the Plating and Alloy Composition

| | Manufacturing Conditions | | | | | | |
|---|---|---|---|---|---|---|---|
| | | | | pH buffer | | Surfactant | |
| Symbol | Zinc sulfate (mol/L) | Chromium sulfate (mol/L) | Sodium sulfate (mol/L) | chemical's name | concentration (mol/L) | chemical's name | concentration (g/L) |
| Inventive sample | | | | | | | |
| 1 | 1 | 0.6 | 0.2 | none | none | acetylene glycol | 1 |
| 2 | 0.7 | 0.6 | 0.5 | boric acid | 0.1 | acetylene glycol | 1 |
| 3 | 0.6 | 0.6 | 0.2 | none | none | acetylene glycol | 1 |
| 4 | 0.6 | 0.6 | 0.2 | none | none | acetylene glycol | 1 |
| Comparative sample | | | | | | | |
| 1 | 1 | none | 0.5 | none | none | polyethylene glycol | 1 |
| 2 | 1 | 0.5 | 0.5 | none | none | polyethylene glycol | 1 |
| 3 | 0.8 | 0.6 | 0.5 | tartaric acid | 0.6 | polyamine | 1 |
| 4 | 0.6 | 0.6 | 0.5 | none | none | polyamine | 1 |
| 5 | 0.6 | 0.6 | 0.5 | tartaric acid | 0.6 | polyethylene glycol | 1 |

| | Manufacturing Conditions | | | | Coating | Percent | |
|---|---|---|---|---|---|---|---|
| Symbol | Bath temperature °C. | pH | Flow rate (mps) | Current density (A/dm$^2$) | weight Zn + Cr (g/m$^2$) | Cr content Cr/(Cr + Zn) (wt %) | Phase structure |
| Inventive sample | | | | | | | |
| 1 | 45 | 1.5 | 1 | 50 | 20 | 2 | ηx |
| 2 | 50 | 1.5 | 1 | 50 | 20 | 5 | ηx |
| 3 | 60 | 1.5 | 2 | 70 | 20 | 10 | ηx |

TABLE 1-continued

| Manufacturing Conditions for Samples of the Invention and Comparative Samples, Coating Weight of the Plating and Alloy Composition | | | | | | | |
|---|---|---|---|---|---|---|---|
| 4 Comparative sample | 50 | 1.5 | 1 | 100 | 20 | 15 | ηx |
| 1 | 50 | 1.5 | 1 | 50 | 20 | 0 | ηx |
| 2 | 50 | 1.5 | 1 | 70 | 20 | 7 | ηx + δx |
| 3 | 50 | 1.5 | 1 | 80 | 20 | 11 | ηx + Γx |
| 4 | 50 | 1.5 | 1 | 90 | 30 | 16 | δx + Γx |
| 5 | 50 | 1.5 | 1 | 100 | 20 | 20 | ηx + δx + Γx |

INDUSTRIAL APPLICABILITY

As described above, the present invention provides an automotive corrosion resistant steel sheet having improved resistance to cosmetic corrosion of a car body.

(B) Second aspect (Γx phase, formability)

Concerning conventional Zn—Cr binary alloys that form intermetallic compounds which are stable at thermal equilibrium state, there has been reported a phase (θ phase) having such a structure that the crystal system is hexagonal and that lattice constants are a=12.89 Å and c=30.5 Å. See, for example, the equilibrium phase diagram shown in M. Hansen, Constitution of binary alloys, p.571, McGraw-Hill. The formula of the θ phase is not completely clear but it is to lie within the range of Cr/(Cr+Zn)=3.8–7 wt %. Other intermetallic compounds have not been reported. Thus, as regards Zn—Cr binary alloys at thermal equilibrium state, only three phases, (1) the η phase of Zn, (2) θ phase, and (3) Cr phase, are held to exist.

In this connection, it should be noted that alloys that are generally formed by electrodeposition will not always produce a thermodynamically stable phase but a non-equilibrium phase may in some cases be produced. It should further be mentioned that various phases will develop depending on manufacturing conditions such as the formula of a plating bath, conditions for electrolysis. Hence, given the same alloy formula, different phase structures may in some cases occur. The present inventors have the opinion that there is correlation between the press formability and the phase structure. Hence, the inventors contemplated that plating layers having improved formability would be produced by specifying the phase structures using effectively the characteristic features of the electrodeposition method.

As for the Zn—Cr binary alloys, there have been no reported cases of intermetallic compounds of such non-equilibrium phase, still less the data of JCPDS cards. Under the circumstances, the present inventors investigated in detail the phase structures of Zn—Cr alloys that were produced by the electrodeposition method. The technique was by electrodepositing alloys with the compositional range of Cr/(Cr+Zn)=0–30 wt % under various manufacturing conditions and then examining the changes in the spacing of lattice planes by X-ray diffractometry. Hereinafter, the amount expressed by Cr/(Cr+Zn) in wt % shall be designated as the percent Cr content. In the case where the percent Cr content is 0 wt %, namely, in the case of pure Zn, the η phase occurs whose crystal system is hexagonal and which has lattice constants of a=2.665 Å and c=4.947 Å.

However, as the percent Cr content was increased gradually, namely, by forming a solid solution of Cr in the η phase, the crystal, which remained in the same system, extended in the direction of a axis but contracted in the direction of c axis; this observation was obtained from the changes in the spacing of lattice planes on the basis of the X-ray diffraction data. It has become clear that up to the point where the percent Cr content is 5 wt % or so, such formation of a solid solution of Cr in the η phase yields only a phase that is characterized by the continuous change in lattice constants. The present inventors will define this phase as ηx.

As the percent Cr content is further increased, peaks in X-ray diffraction pattern will appear that can be ascribed to phases obviously different from ηx. however, the percent Cr content at which those peaks appear differs with the manufacturing conditions. By repeated calculations with the assumption of crystal system and lattice constants and by comparing the results with the spacing of lattice planes as determined from X-ray diffraction pattern, it has become clear that in addition to ηx, there also exist a phase having such a structure that the crystal system is hexagonal and that lattice constants are a=2.72–2.78 Å and c=4.43–4.60 Å (which phase is defined as the δx phase), as well as a phase having such a structure that the crystal system is cubic and that a lattice constant is a=3.00–3.06 Å (which phase is defined as Γx). These results are shown in FIG. 5. The percent Cr content at which the ηx, δx and Γx phases develop differs with the manufacturing conditions and, hence, defies generalization instead, the results obtained under several manufacturing conditions are shown in FIG. 6 as examples. As discussed above, the phase structures of electrodeposited Zn—Cr alloys would be solely composed of three phases.

In the next place, the present inventors produced Zn—Cr alloy plated steel sheets under various conditions and examined the relationship between their formability and the coating weight of the plating. To their surprise, it became clear that the formability of the Zn—Cr alloy plated steel sheet that was substantially solely composed of the Γx phase was outstandingly superior to that of Zn—Cr alloy plated steel sheets containing the ηx or δx phase.

Thus, it has become clear that by applying a Zn—Cr alloy plating which is an alloy consisting of Zn and Cr as formed by electrodeposition and which is substantially solely composed of a phase having such a structure that the crystal system is cubic and that a lattice constant is a=3.00–3.06 Å, one can obtain a Zn—Cr alloy plated steel sheet having significantly improved formability.

As already mentioned above, the range of percent Cr content for producing the Zn—Cr alloy plating that is substantially solely composed of the Γx phase defies generalized definition since it varies with the manufacturing process but it is desirably 5–30 wt %. This is because below 5 wt %, the Γx phase will not develop whereas above 30 wt %, the adhesion of the plating layer per se will deteriorate, which is detrimental to the effectiveness of the present invention. The coating weight of the plating is desirably 10–40 g/m$^2$, only insufficient corrosion results whereas above 40 g/m$^2$, the formability will deteriorate. Desirably, satisfactory corrosion resistance and formability are assured in the range from 20 to 30 g/m$^2$.

The manufacturing conditions for obtaining the Zn—Cr alloy plating of the present invention may be exemplified, but in no way limited, by electrodeposition from a sulfate bath which contains zinc sulfate and chromium sulfate as primary agents, sodium sulfate as an electroconductive aid, boric acid or various other organic acids as pH buffers, as well as various surfactants.

Other conditions such as the pH of the bath, its temperature, the liquid flow rate and the current density for electrolysis are selected as appropriate for producing a desired phase structure. Since all of these conditions are influential on the phase structure, the alloy plating that is substantially solely composed of Γx is obtained only in the case where those conditions are combined in an appropriate way.

It should be mentioned that when performing electroplating in practice on an industrial scale, there can be the case where phases other than the Γx phase will develop inevitably even under optimal plating conditions; however, contamination by small amounts of extraneous phases is in no way excluded as long as they are within the range over which the plating proves to be as effective as the plating that is composed of the pure Γx phase, and it should be understood that such range may be included in the definition of the expression "substantially composed of the Γx phase" as used in the present invention.

The advantage of the second aspect of the preset invention is described below on the basis of an example.

EXAMPLE 2

Table 2 lists the manufacturing conditions for inventive samples and comparative samples, the coating weight of the plating, percent Cr content and the phase structure. In all cases, SPCD (cold rolled steel sheet) with a sheet thickness of 0.7 mm was used as substrate, which was degreased and pickled in the usual manner, followed by plating to prepare samples. Each of the invention was substantially solely composed of the Γx phase whereas the comparative samples obviously contained the ηx or δx phase. It should, however, be noted that those samples which contained up to about 1% of the ηx phase and/or the δx phase were considered to be substantially solely composed of the Γx phase. Using the samples listed in Table 2, formability was evaluated. The evaluation of formability was conducted by the following procedure: after oil application, the test specimens were subjected to drawing with a 35 mmϕ punch at a blank holding force of 1 ton and at a punching speed of 120 mm/min, and the limiting draw ratio (LDR) was determined for evaluation. In addition, for the sake of comparison, LDR was also determined on commercial GA 60 (GA with coating weight of 60 g/m2), Zn—Ni 30 (Zn—Ni alloy plated steel sheet with coating weight of 30 g/m$^2$) and EG 30 (EG with coating weight of 30 g/m2).

Figure 8:
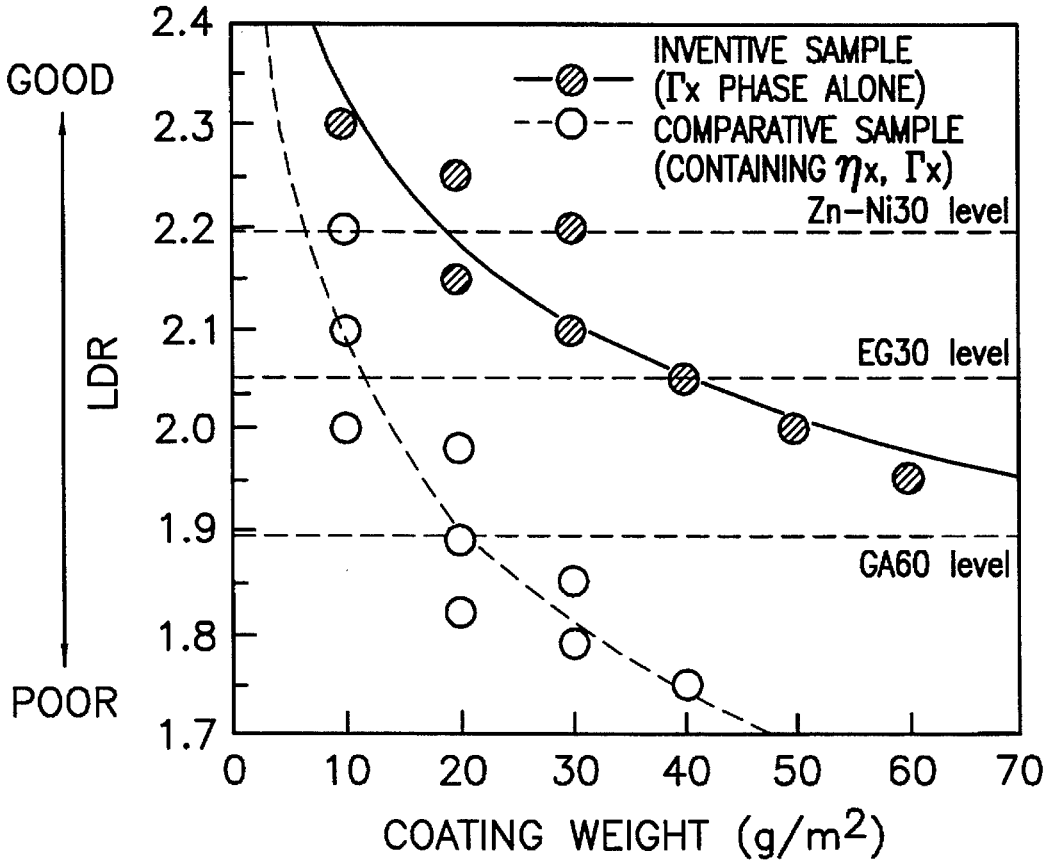
FIG. 8 is a diagram depicting the effect of phase structure on the relationship between the formability (LDR) of the Zn—Cr alloy plated steel sheet and the coating weight of the platings.

The results of these measurements are shown in FIG. 8. As one can see from FIG. 8, the formability of the comparative samples deteriorated sharply with the increasing coating weight. As already mentioned, in order to insure that Zn—Cr alloy plated steel sheets have comparable corrosion resistance to GA 60 which is domestically used today in the largest quantities, a coating weight of at least about 30 g/m$^2$ is necessary. However, one can see that with coating weights of 30 g/m$^2$ or more, the formability of the comparative samples was inferior, rather than superior, to GA 60. On the other hand, when the phase structure of the plating layer was controlled in such a way that it was substantially solely composed of the Γx phase, less deterioration in formability occurred even with the coating weight at 30 g/m$^2$. Considering that the press formability of existing corrosion resistant steel sheets is the best with the Zn—Ni alloy plated steel sheet, somewhat inferior with EG and that GA with the higher coating weight is even less satisfactory in formability, one may well conclude that the Zn—Cr alloy plated steel sheet of the present invention has reasonably good formability in the region of coating weights that insure good corrosion resistance.

TABLE 2-1

| | Manufacturing Conditions | | | | | | |
|---|---|---|---|---|---|---|---|
| | | | | pH buffer | | Surfactant | |
| Symbol | Zinc sulfate (mol/L) | Chromium sulfate (mol/L) | Sodium sulfate (mol/L) | chemical's name | concentration (g/L) | chemical's name | concentration (g/L) |
| Inventive sample 1 | 0.6 | 0.4 | 0.5 | boric acid | 0.5 | acetylene glycol | 1 |
| Inventive sample 2 | 0.6 | 0.6 | 0.5 | malic acid Na | 0.6 | acetylene glycol | 2 |
| Inventive sample 3 | 1 | 0.5 | 0.5 | none | none | acetylene glycol | 1 |
| Inventive sample 4 | 0.8 | 0.7 | 0.5 | malic acid Na | 1 | acetylene glycol | 1 |
| Inventive sample 5 | 1.5 | 0.5 | 0.5 | boric acid | 0.5 | acetylene glycol | 1 |
| Inventive sample 6 | 0.5 | 0.6 | 0.5 | malic acid Na | 0.8 | acetylene glycol | 2 |
| Inventive sample 7 | 1.3 | 0.6 | 0.5 | citric acid Na | 0.4 | acetylene glycol | 1 |
| Inventive sample 8 | 1.5 | 0.5 | 0.5 | malic acid Na | 0.5 | acetylene glycol | 1 |
| Comparative sample 1 | 1 | 0.8 | 0.5 | none | none | polyethylene glycol | 1 |
| Comparative sample 2 | 1.5 | 0.5 | 0.5 | none | none | polyamine | 1 |
| Comparative sample 3 | 1.5 | 0.5 | 0.5 | tartaric acid Na | 0.5 | acetylene glycol | 1 |

TABLE 2-1-continued

| Symbol | Manufacturing Conditions | | | | | | |
|---|---|---|---|---|---|---|---|
| | | | | pH buffer | | Surfactant | |
| | Zinc sulfate (mol/L) | Chromium sulfate (mol/L) | Sodium sulfate (mol/L) | chemical's name | concen-tration (g/L) | chemical's name | concen-tration (g/L) |
| Comparative sample 4 | 0.8 | 0.6 | 0.5 | none | none | polyethylene glycol | 1 |
| Comparative sample 5 | 1 | 0.4 | 0.5 | none | none | polyethylene glycol | 1 |
| Comparative sample 6 | 1 | 0.4 | 0.5 | none | none | polyethylene glycol | 1 |
| Comparative sample 7 | 1 | 0.8 | 0.5 | none | none | polyethylene glycol | 1 |
| Comparative sample 8 | 1 | 0.5 | 0.5 | none | none | polyamine | 1 |
| Comparative sample 9 | 1 | 0.5 | 0.5 | none | none | polyethylene glycol | 1 |

TABLE 2-2

| Symbol | Manufacturing Conditions | | | | Coating | Percent | |
|---|---|---|---|---|---|---|---|
| | Bath temperature (°C.) | pH | Flow rate of plating solution (mps) | Current density ($A/dm^2$) | weight Zn + Cr ($g/m^2$) | Cr content Cr/Cr + Zn (wt %) | Phase structure |
| Inventive sample 1 | 50 | 1.5 | 2 | 80 | 10 | 10 | Γx |
| Inventive sample 2 | 50 | 1.6 | 2 | 90 | 20 | 20 | Γx |
| Inventive sample 3 | 40 | 1.7 | 1 | 60 | 20 | 20 | Γx |
| Inventive sample 4 | 60 | 1.5 | 1 | 100 | 30 | 30 | Γx |
| Inventive sample 5 | 50 | 1.5 | 1 | 80 | 30 | 30 | Γx |
| Inventive sample 6 | 50 | 1.6 | 1 | 90 | 40 | 40 | Γx |
| Inventive sample 7 | 40 | 1.3 | 2 | 70 | 50 | 50 | Γx |
| Inventive sample 8 | 50 | 1.5 | 1 | 80 | 60 | 60 | Γx |
| Comparative sample 1 | 50 | 1.6 | 1 | 100 | 10 | 10 | ηx + δx + Γx |
| Comparative sample 2 | 50 | 1.6 | 1 | 80 | 10 | 10 | ηx + Γx |
| Comparative sample 3 | 50 | 1.6 | 1 | 50 | 10 | 10 | δx |
| Comparative sample 4 | 50 | 1.6 | 1 | 80 | 20 | 20 | δx + Γx |
| Comparative sample 5 | 50 | 1.6 | 1 | 60 | 20 | 20 | ηx + δx |
| Comparative sample 6 | 50 | 1.6 | 1 | 40 | 20 | 20 | ηx |
| Comparative sample 7 | 50 | 1.6 | 1 | 100 | 30 | 30 | ηx + Γx |
| Comparative sample 8 | 50 | 1.6 | 1 | 60 | 30 | 30 | ηx |
| Comparative sample 9 | 50 | 1.6 | 1 | 100 | 40 | 40 | ηx + δx |

INDUSTRIAL APPLICABILITY

As described above, the present invention provides a corrosion resistant steel sheet that insures satisfactory corrosion resistance and which yet exhibits excellent formability.

(C) Third aspect (ηx+δx phase, resistance to chipping)

Concerning conventional Zn—Cr binary alloys that form intermetallic compounds which are stable at thermal equilibrium state, there has been reported a phase (θ phase) having such a structure that the crystal system is hexagonal and that lattice constants are a=12.89 Å and c=30.5 Å. See, for example, the equilibrium phase diagram shown in M. Hansen, Constitution of binary alloys, p. 571, McGraw-Hill. The formula of the θ phase is not completely clear but it is to lie within the range of Cr/(Cr+Zn)=3.8–7 wt %. Other intermetallic compounds have not been reported. Thus, as regards Zn—Cr binary alloys at thermal equilibrium state, only three phases, (1) the η phase of Zn, (2) θ phase, and (3) Cr phase, are held to exist.

In this connection, it should be noted that alloys that are generally formed by electrodeposition will not always produce a thermodynamically stable phase but a non-equilibrium phase can in some cases be produced. It should further be mentioned that various phases will develop depending on manufacturing conditions such as the formula of a plating bath, conditions for electrolysis. Hence, given the same alloy formula, different phase structures could in some cases occur. The present inventors have the opinion that there is correlation between the resistance to chipping and the phase structure. Hence, the inventors contemplated that plating layers having improved resistance to chipping would be produced by specifying the phase structures using effectively the characteristic features of the electrodeposition method.

As for the Zn—Cr binary alloys, there have been no reported cases of intermetallic compounds of such non-equilibrium phase, still less the data of JCPDS cards. Under the circumstances, the present inventors investigated in detail the phase structures of Zn—Cr alloys that were produced by the electrodeposition method. The technique was by electrodepositing alloys with the compositional range of Cr/(Cr+Zn)=0–30 wt % under various manufacturing conditions and then examining the changes in the spacing of lattice planes by X-ray diffractometry. Hereinafter, the amount expressed by Cr/(Cr+Zn) in wt % shall be designated as the percent Cr content. In the case where the percent Cr content is 0 wt %, namely, in the case of pure Zn, the η phase occurs whose crystal system is hexagonal and which has lattice constants of a=2.665 Å and c=4.947 Å.

However, as the percent Cr content was increased gradually, namely, by forming a solid solution of Cr in the η phase, the crystal, which remained in the same system, extended in the direction of a axis but contracted in the direction of c axis; this observation was obtained from the changes in the spacing of lattice planes on the basis of the X-ray diffraction data. It has become clear that up to the point where the percent Cr content is 5 wt % or so, such formation of a solid solution of Cr in the η phase yields only a phase that is characterized by the continuous change in lattice constants. The present inventors will define this phase as ηx.

As the percent Cr content is further increased, peaks in X-ray diffraction pattern will appear that can be ascribed to phases obviously different from ηx. However, the percent Cr content at which those peaks appear differs with the manufacturing conditions. By repeated calculations with the assumption of crystal system and lattice constants and by comparing the results with the spacing of lattice planes as determined from X-ray diffraction pattern, it has become clear that in addition to ηx, there also exist a phase having such a structure that the crystal system is hexagonal and that lattice constants are a=2.72–2.78 Å and c=4.43–4.60 Å (which phase is defined as the δx phase), as well as a phase having such a structure that the crystal system is cubic and that a lattice constant is a=3.00–3.06 Å (which phase is defined as the Γx phase). These results are shown in FIG. 5. The percent Cr content at which the ηx, δx and Γx phases develop differs with the manufacturing conditions and, hence, defies generalization; instead, the results obtained under several manufacturing conditions are shown in FIG. 6 as examples. As discussed above, the phase structures of electrodeposited Zn—Cr alloys would be solely composed of three phases.

In the next place, the present inventors produced Zn—Cr alloy plated steel sheets under various conditions and examined the relationship between their resistance to chipping and the alloy composition. To their surprise, it became clear that the chipping resistance of the Zn—Cr alloy plated steel sheet that was substantially composed of the ηx and δx phases was outstandingly superior to that of Zn—Cr alloy plated steel sheets containing otherwise combined phases (including the case of single phases). The expression composed "substantially of two or more phases" means the case where two or more phases are substantially present in whatever proportions or modes of distribution.

Thus, it has become clear that by applying a Zn—Cr alloy plating which is an alloy consisting of Zn and Cr as formed by electrodeposition and which is substantially composed of a phase having such a structure that the crystal system is hexagonal and that lattice constants are a=2.66–2.74 Å and c=4.61–4.95 Å, as well as a phase having such a structure that the crystal system is hexagonal and that lattice constants are a=2.72–2.78 Å and c=4.43–4.60 Å, one can obtain a Zn—Cr alloy plated steel sheet having improved resistance to chipping.

As already mentioned above, the range of percent Cr content for producing the Zn—Cr alloy plating that is substantially composed of the ηx and δx phases defies generalized definition since it varies with the manufacturing process but it is desirably 5–30 wt %. This is because below 5 wt %, only insufficient corrosion resistance results whereas above 30 wt % the adhesion of the plating layer per se will deteriorate, which is detrimental to the effectiveness of the present invention. The coating weight of the plating is desirably 10–40 g/m$^2$ because below coating weight of 10 g/m$^2$, only insufficient corrosion resistance results whereas above coating weight of 40 g/m$^2$, there is no cost merit.

The manufacturing conditions for obtaining the Zn—Cr alloy plating of the present invention may be exemplified, but in no way limited, by electrodeposition from a sulfate bath which contains zinc sulfate and chromium sulfate as primary agents, sodium sulfate as an electroconductive aid, boric acid or various other organic acids as pH buffers, as well as various surfactants.

Other conditions such as the pH of the bath, its temperature, the liquid flow rate and the current density for electrolysis are selected as appropriate for producing a desired phase structure. Since all of these conditions are influential on the phase structure, the alloy plating that is substantially composed of ηx and δx phases alone is obtained only in the case where those conditions are combined in an appropriate way.

It should be mentioned that when performing electroplating in practice on an industrial scale, there can be the case where phases other than the ηx, δx and Γx phases will develop inevitably even under optimal plating conditions; however, contamination by small amounts of extraneous phases is in no way excluded as long as they are within the range over which the plating proves to be as effective as the plating that is composed of the pure ηx phase and δx phase, and it should be understood that such range may be included in the definition of the expression "substantially composed of the ηx and δx phases" as used in the present invention.

The advantage of the third aspect of the present invention is described below on the basis of an example.

EXAMPLE 3

Figure 9:
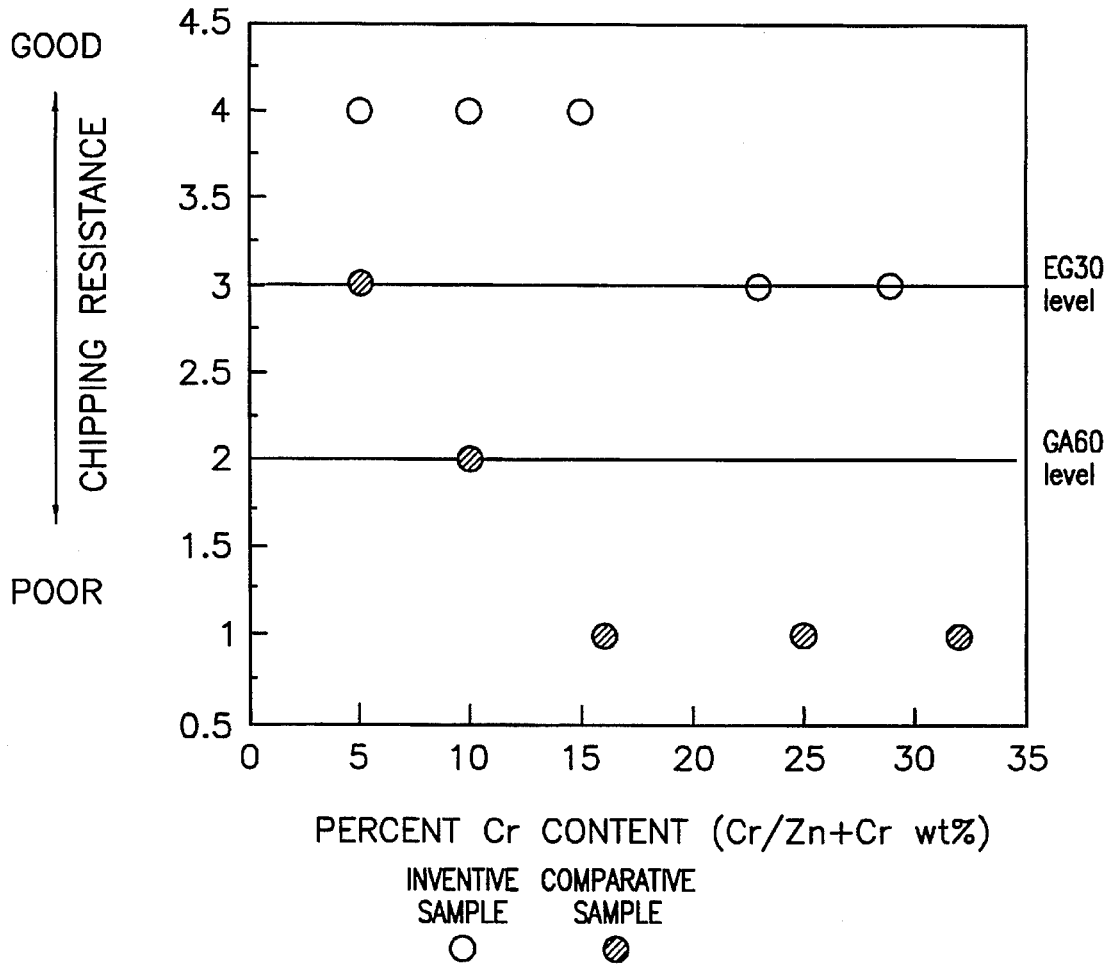
FIG. 9 is a diagram showing the relationship between the chipping resistance of the Zn—Cr alloy plated steel sheet and the percent Cr contents.

Table 3 lists the manufacturing conditions for inventive samples and comparative samples, the coating weight of the plating, percent Cr content and the phase structure. In all cases, SPCD (cold rolled steel sheet) with a sheet thickness of 0.7 mm was used as substrate, which was degreased and pickled in the usual manner, followed by plating to prepare samples. Each inventive sample was substantially composed of the ηx and δx phases whereas the comparative samples comprised combinations of other phases. It should, however, be noted that those samples which contained up to about 1% of the Γx phase were considered to be substantially composed of the ηx and δx phases. Using the samples listed in Table 3, resistance to chipping was evaluated. The evaluation of chipping resistance was conducted by the following procedure; a test specimen of 150 mm×70 mm was subjected to the chemical conversion treatment with zinc phosphate in the same manner as it was effected on ordinary automotive cold rolled steel sheets; thereafter, three-coat application was performed consisting of cationic electrodeposition coating (PTV-80 of Nippon Paint Co., Ltd.), intermediate coating (TP37 of Kansai Paint Co., Ltd.) and top coating (TM13RC of Kansai Paint Co., Ltd.); a gravelometer in compliance with SAE J 400 was used to have road surfacing gravels (specified in JIS A 5001) blown against the test specimen; thereafter, an adhesive tape was applied over the blown surface and quickly pulled off; the state of peeling of the coatings was evaluated by the following criteria. FIG. 9 shows that the chipping resistance of the Zn—Cr alloy plated steel sheets that satisfied the conditions of the present invention was improved to levels almost comparable to that of commercial EG 30.

Criteria for the Evaluation of Chipping Resistance

⊙- - - no peeling (4)

○- - - slight peeling (3)

Δ- - - moderate peeling (2)

x - - - extensive peeling (1)

TABLE 3

| | Manufacturing Conditions | | | | | | |
|---|---|---|---|---|---|---|---|
| | | | | pH buffer | | Surfactant | |
| Symbol | Zinc sulfate mol/L | Chromium sulfate mol/L | Sodium sulfate mol/L | chemical's name | concentration mol/L | chemical's name | concentration g/L |
| Inventive sample | | | | | | | |
| 1 | 0.9 | 0.8 | 0.5 | boric acid | 0.1 | acetylene glycol | 1 |
| 2 | 0.8 | 0.8 | 0.2 | none | none | acetylene glycol | 1 |
| 3 | 0.8 | 0.8 | 0.2 | none | none | acetylene glycol | 1 |
| 4 | 0.8 | 0.8 | 0.2 | malic acid | 0.6 | acetylene glycol | 1 |
| 5 | 0.8 | 0.8 | 0.2 | none | none | acetylene glycol | 1 |
| Comparative sample | | | | | | | |
| 1 | 1 | 0.3 | 0.5 | none | none | polyethylene glycol | 1 |
| 2 | 1 | 0.5 | 0.5 | none | none | polyethylene glycol | 1 |
| 3 | 0.9 | 0.6 | 0.5 | tartaric acid | 0.6 | polyamine | 1 |
| 4 | 0.9 | 0.9 | 0.5 | tartaric acid | 0.6 | polyamine | 1 |
| 5 | 0.9 | 0.9 | 0.5 | none | none | polyethylene glycol | 1 |

| | Manufacturing Conditions | | | | Coating | Percent | |
|---|---|---|---|---|---|---|---|
| Symbol | Temperature °C. | pH | Flow rate mps | Current density A/dm$^2$ | weight Zn + Cr (g/m$^2$) | Cr content Cr/(Cr + Zn) (wt %) | Phase structure |
| Inventive sample | | | | | | | |
| 1 | 50 | 1.5 | 1 | 50 | 20 | 5 | ηx + δx |
| 2 | 60 | 1.5 | 2 | 80 | 20 | 10 | ηx + δx |
| 3 | 50 | 1.5 | 1 | 110 | 20 | 15 | ηx + δx |
| 4 | 60 | 1.6 | 1 | 100 | 20 | 23 | ηx + δx |
| 5 | 60 | 1.6 | 1 | 120 | 20 | 29 | ηx + δx |
| Comparative sample | | | | | | | |
| 1 | 50 | 1.5 | 1 | 80 | 20 | 5 | ηx |
| 2 | 50 | 1.5 | 1 | 80 | 20 | 10 | δx |
| 3 | 50 | 1.5 | 1 | 100 | 20 | 16 | ηx + δx + Γx |
| 4 | 50 | 1.5 | 1 | 110 | 20 | 25 | δx + Γx |
| 5 | 50 | 1.5 | 1 | 100 | 20 | 32 | ηx + Γx |

INDUSTRIAL APPLICABILITY

As described above, the present invention provides a corrosion resistant steel sheet having improved resistance to chipping.

(D) Fourth aspect (ηx+Γx phase, corrosion resistance in the as-formed state)

Concerning conventional Zn—Cr binary alloys that form alloys which are stable at thermal equilibrium state, there has been reported a phase (θ phase) having such a structure that the crystal system is hexagonal and that lattice constants are a=12.89 Å and c=30.5 Å. See, for example, the equilibrium phase diagram shown in M. Hansen, Constitution of binary alloys, p. 571, McGraw-Hill. The formula of the θ phase is not completely clear but it is to lie within the range of Cr/(Cr+Zn)=3.8–7 wt %. Other alloys have not been reported. Thus, as regards Zn—Cr binary alloys at thermal equilibrium state, only three phases, (1) the η phase of Zn, (2) θ phase, and (3) Cr phase, are held to exist.

In this connection, it should be noted that alloys that are generally formed by electrodeposition will not always produce a thermodynamically stable phase but a non-equilibrium phase can in some cases be produced. It should further be mentioned that various phases could develop depending on manufacturing conditions such as the formula of a plating bath, conditions for electrolysis. Hence, given the same alloy formula, different phase structures could in some cases occur. The present inventors have the opinion that there is correlation between the corrosion resistance in the as-formed state and the phase structure. Hence, the inventors contemplated that plating layers having improved corrosion resistance in the as-formed state would be produced by specifying the phase structures using effectively the characteristic features of the electrodeposition method.

As for the Zn—Cr binary alloys, there have been no reported cases of alloys of such non-equilibrium phase, still less the data of JCPDS cards. Under the circumstances, the present inventors investigated in detail the phase structures of Zn—Cr alloys that were produced by the electrodeposition method. The technique was by electrodepositing alloys with the compositional range of Cr/(Cr+Zn)=0–30 wt % under various manufacturing conditions and then examining the changes in the spacing of lattice planes by X-ray diffractometry. Hereinafter, the amount expressed by Cr/(Cr+Zn) in wt % shall be designated as the percent Cr content.

In the case where the percent Cr content is 0 wt %, namely, in the case of pure Zn, the η phase occurs whose crystal system is hexagonal and which has lattice constants of a=2.665 Å and c=4.947 Å. However, as the percent Cr content was increased gradually, namely, by forming a solid solution of Cr in the η phase, the crystal, which remained in the same system, extended in the direction of a axis but contracted in the direction of c axis; this observation was obtained from the changes in the spacing of lattice planes on the basis of the X-ray diffraction data. It has become clear that up to the point where the percent Cr content is 5 wt % or so, such formation of a solid solution of Cr in the η phase yields only a phase that is characterized by the continuous change in lattice constants and in which lattice constants are a=2.66–2.74 Å and c=4.61–4.95 Å. The present inventors will define this phase as ηx.

As the percent Cr content is further increased, peaks in X-ray diffraction pattern will appear that can be ascribed to phases obviously different from ηx. However, the percent Cr content at which those peaks appear differs with the manufacturing conditions. By repeated calculations with the assumption of crystal system and lattice constants and by comparing the results with the spacing of lattice planes as determined from X-ray diffraction pattern, it has become clear that in addition to ηx, there also exist a phase having such a structure that the crystal system is hexagonal and that lattice constants are a=2.72–2.78 Å and c=4.43–4.60 Å (which phase is defined as the δx phase), as well as a phase having such a structure that the crystal system is cubic and that a lattice constant is a=3.00–3.06 Å (which phase is defined as the Γx phase). These results are shown in FIG. 5. The percent Cr content at which the ηx, δx and Γx phases develop differs with the manufacturing conditions and, hence, defies generalization; instead, the results obtained under several manufacturing conditions are shown in FIG. 6 as examples. As discussed above, the phase structures of electrodeposited Zn—Cr alloys would be solely composed of three phases.

In the next place, the present inventors produced Zn—Cr alloy plated steel sheets under various conditions and examined the relationship between their corrosion resistance in the as-formed state and the percent Cr content. It became clear that the corrosion resistance in the as formed state of the Zn—Cr alloy plated steel sheet that was substantially composed of the ηx and Γx phases had good characteristics in that it deteriorated less than before the forming was done.

Thus, it has become clear that by applying a Zn—Cr alloy plating which is an alloy consisting of Zn and Cr as formed by electrodeposition and which is substantially composed of a phase having such a structure that the crystal system is hexagonal and that lattice constants are a=2.66–2.74 Å and c=4.61–4.95 Å, as well as a phase having such a structure that the crystal system is cubic and that a lattice constant is a=3.00–3.06 Å, one can obtain a Zn—Cr alloy plated steel sheet having improved corrosion resistance in the as-formed state.

As already mentioned above, the range of percent Cr content for producing the Zn—Cr alloy plating that is substantially composed of the ηx and Γx phases defies generalized definition since it varies with the manufacturing process but it is desirably 5–30 wt %. This is because below 5 wt %, the Γx phase will not develop whereas above 30 wt %, the adhesion of the plating layer before coatings are applied will deteriorate, which is detrimental to the effectiveness of the present invention. The coating weight of the plating is desirably 10–40 g/m$^2$ because below 10 g/m$^2$, only insufficient corrosion resistance results whereas above 40 g/m$^2$, there is no cost merit.

The manufacturing conditions for obtaining the Zn—Cr alloy plating of the present invention may be exemplified, but in no way limited, by electrodeposition from a sulfate bath which contains zinc sulfate and chromium sulfate as primary agents, sodium sulfate as an electroconductive aid, boric acid or various other organic acids as pH buffers, as well as various surfactants. Other conditions such as the pH of the bath, its temperature, the liquid flow rate and the current density for electrolysis are selected as appropriate for producing a desired phase structure. Since all of these conditions are influential on the phase structure, the alloy plating that is substantially composed of ηx and Γx phases alone is obtained only in the case where those conditions are combined in an appropriate way.

It should be mentioned that when performing electroplating in practice on an industrial scale, there can be the case where phases other than the ηx and Γx phases will develop inevitably even under optimal plating conditions; however, contamination by small amounts of extraneous phases is in no way excluded as long as they are within the range over which the plating proves to be as effective as the plating that is composed of the pure ηx phase and Γx phase, and it should be understood that such range may be included in the definition of the expression "substantially composed of the ηx and Γx phases" as used in the present invention.

The advantage of the fourth aspect of the present invention is described below on the basis of an example.

EXAMPLE 4

Figure 10:
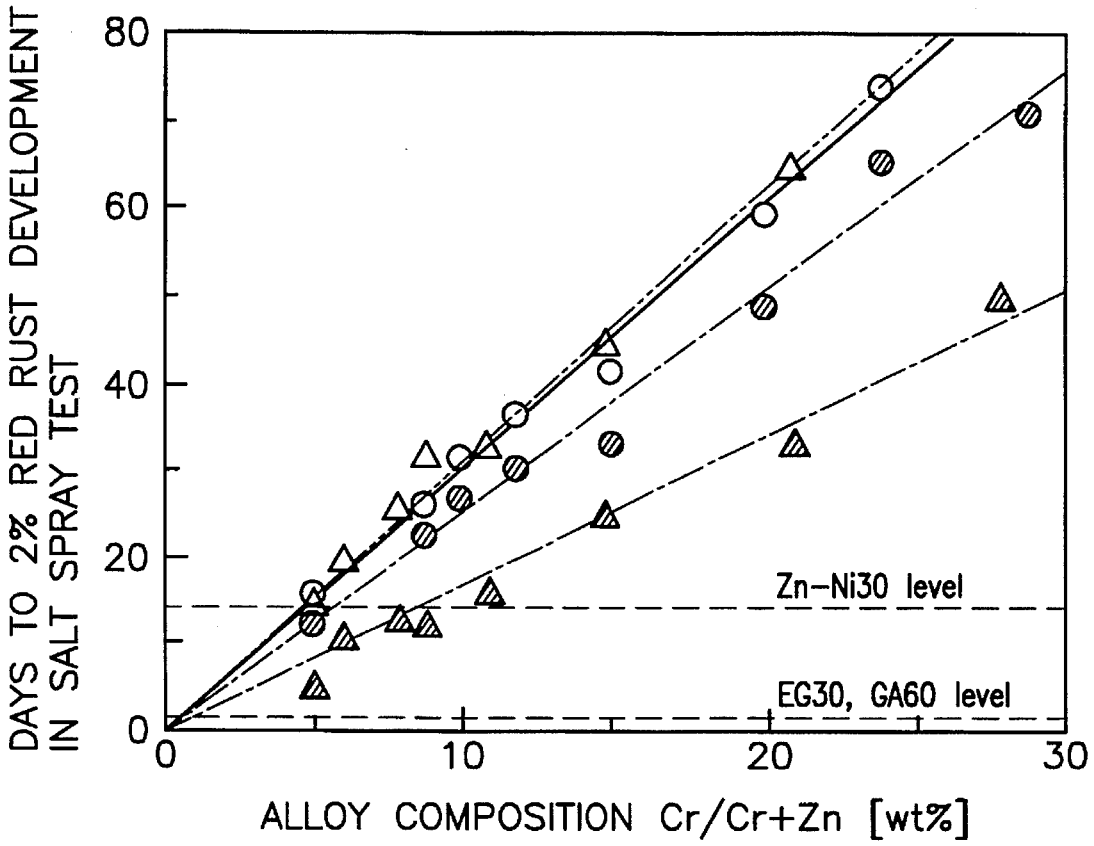
FIG. 10 is a pair of diagrams showing how the percent content of Cr in the plating layer of the Zn—Cr alloy plated steel sheet is related to its corrosion resistance in the form of a bare flat plate, as well its corrosion resistance after forming by hat drawing, with 10(a) referring to the case of plated steel sheets substantially having the ηx and Γx phases and 10(b) showing comparative samples having other phase combinations.

Table 4 lists the manufacturing conditions for inventive samples and comparative samples, the coating weight of the plating, percent Cr content and the phase structure. In all cases, SPCD (cold rolled steel sheet) with a sheet thickness of 0.7 mm was used as substrate, which was degreased and pickled in the usual manner, followed by plating to prepare samples. Each sample of the invention was substantially composed of the ηx and Γx phases whereas the comparative samples comprised combinations of other phases. It should, however, be noted that those samples which contained up to about 1% of the δx phase were considered to be substantially composed of the ηx and Γx phases. Using the samples listed in Table 4, the corrosion resistance of flat plate in the bare state, as well as their corrosion resistance after forming by hat drawing were evaluated. The method of evaluation was by conducting a salt spray test in accordance with JIS Z 2371 and then checking the number of days to 2% red rust development. The results are shown in FIG. 10. For the sake of comparison, FIG. 10(*a*) shows the number of test cycles for evaluating the corrosion resistance of conventional Zn base plates in the bare state after forming by hat drawing. Compared to the comparative samples shown in FIG. 10(*b*), the inventive Zn—Cr alloy plated samples shown in FIG. 10(*a*) which were substantially composed of the ηx and Γx phases experienced less deterioration, and this demonstrates their superior corrosion resistance in the as-formed state.

TABLE 4

Manufacturing Conditions for Samples of the Invention and Comparative Samples, Coating Weight of the Plating and Alloy Composition

| | Manufacturing Conditions | | | | | |
|---|---|---|---|---|---|---|
| | | | | Surfactant | | |
| Symbol | Zinc sulfate (mol/L) | Chromium sulfate (mol/L) | Sodium sulfate (mol/L) | chemical's name | concen-tration (g/L) | Bath temper-ature (°C.) |
| Inventive sample 1 | 1.5 | 0.5 | 0.5 | acetylene glycol | 1 | 50 |
| Inventive sample 2 | 1.0 | 0.8 | 0.5 | acetylene glycol | 1 | 50 |
| Inventive sample 3 | 1.5 | 0.5 | 0.5 | acetylene glycol | 1 | 50 |
| Inventive sample 4 | 1.0 | 0.5 | 0.5 | acetylene glycol | 1 | 50 |
| Inventive sample 5 | 1.5 | 0.5 | 0.5 | acetylene glycol | 1 | 50 |
| Inventive sample 6 | 1.5 | 0.8 | 0.5 | acetylene glycol | 1 | 50 |
| Inventive sample 7 | 1.0 | 0.8 | 0.5 | acetylene glycol | 1 | 50 |
| Inventive sample 8 | 1.0 | 0.5 | 0.5 | acetylene glycol | 1 | 50 |
| Comparative sample 1 | 1.0 | 0.8 | 0.5 | polyethylene glycol | 1 | 50 |
| Comparative sample 2 | 0.8 | 0.6 | 0.5 | polyethylene glycol | 1 | 50 |
| Comparative sample 3 | 1.0 | 0.4 | 0.5 | polyethylene glycol | 1 | 50 |
| Comparative sample 4 | 1.0 | 0.4 | 0.5 | polyethylene glycol | 1 | 50 |
| Comparative sample 5 | 1.0 | 0.5 | 0.5 | polyamine | 1 | 50 |
| Comparative sample 6 | 1.0 | 0.5 | 0.5 | polyethylene glycol | 1 | 50 |
| Comparative sample 7 | 1.0 | 0.8 | 0.5 | polyethylene glycol | 1 | 50 |
| Comparative sample 8 | 1.0 | 0.8 | 0.5 | polyethylene glycol | 1 | 50 |

| | Manufacturing Conditions | | | | | |
|---|---|---|---|---|---|---|
| Symbol | pH | Flow rate of plating solution (mps) | Current density (A/dm$^2$) | Coating weight Zn + Cr (g/m$^2$) | Percent Cr content Cr/(Cr + Zn) (wt %) | Phase structure |
| Inventive sample 1 | 1.6 | 1 | 80 | 20 | 10 | ηx + Γx |
| Inventive sample 2 | 1.6 | 1 | 100 | 20 | 15 | ηx + Γx |
| Inventive sample 3 | 1.5 | 1 | 80 | 20 | 24 | ηx + Γx |

TABLE 4-continued

Manufacturing Conditions for Samples of the Invention and Comparative Samples, Coating Weight of the Plating and Alloy Composition

| | | | | | | |
|---|---|---|---|---|---|---|
| Inventive sample 4 | 1.5 | 1 | 100 | 20 | 12 | ηx + Γx |
| Inventive sample 5 | 1.5 | 1 | 100 | 20 | 29 | ηx + Γx |
| Inventive sample 6 | 1.5 | 1 | 80 | 20 | 5 | ηx + Γx |
| Inventive sample 7 | 1.5 | 1 | 80 | 20 | 9 | ηx + Γx |
| Inventive sample 8 | 1.5 | 1 | 80 | 20 | 20 | ηx + Γx |
| Comparative sample 1 | 1.6 | 1 | 100 | 20 | 21 | δx + Γx |
| Comparative sample 2 | 1.6 | 1 | 80 | 20 | 28 | Γx |
| Comparative sample 3 | 1.6 | 1 | 60 | 20 | 8 | ηx + δx |
| Comparative sample 4 | 1.6 | 1 | 40 | 20 | 5 | ηx |
| Comparative sample 5 | 1.6 | 1 | 60 | 20 | 9 | ηx + δx |
| Comparative sample 6 | 1.6 | 1 | 100 | 20 | 11 | δx |
| Comparative sample 7 | 1.0 | 1 | 100 | 20 | 6 | ηx |
| Comparative sample 8 | 1.0 | 1 | 100 | 20 | 15 | ηx + δx + Γx |

INDUSTRIAL APPLICABILITY

As described above, the present invention provides a corrosion resistant steel sheet for use on automobiles and the like which is improved not only in corrosion resistance before forming but also in corrosion resistance after forming.

(E) Fifth aspect (δx+Γx phase, water resistant secondary adherence of coating)

Concerning conventional Zn—Cr binary alloys that form alloys which are stable at thermal equilibrium state, there has been reported a phase (θ phase) having such a structure that the crystal system is hexagonal and that lattice constants are a=12.89 Å and c=30.5 Å. See, for example, the equilibrium phase diagram shown in M. Hansen, Constitution of binary alloys, p. 571, McGRAW-HILL. The formula of the θ phase is not completely clear but it is to lie within the range of Cr/(Cr+Zn)=3.8–7 wt %. Other alloys have not been reported. Thus, as regards Zn—Cr binary alloys at thermal equilibrium state, only three phases, (1) the η phase of Zn, (2) θ phase, and (3) Cr phase, are held to exist.

In this connection, it should be noted that alloys that are generally formed by electrodeposition will not always produce a thermodynamically stable phase but a non-equilibrium phase can in some cases be produced. It should further be mentioned that various phases could develop depending on manufacturing conditions such as the formula of a plating bath, conditions for electrolysis. Hence, given the same alloy formula, different phase structures could in some cases occur. The present inventors have the opinion that there is correlation between the water resistant secondary adherence of coating and the phase structure. Hence, the inventors contemplated that plating layers having improved water resistant secondary adherence of coating would be produced by specifying the phase structures using effectively the characteristic features of the electrodeposition method.

As for the Zn—Cr binary alloys, there have been no reported cases of alloys of such non-equilibrium phase, still less the data of JCPDS cards. Under the circumstances, the present inventors investigated in detail the phase structures of Zn—Cr alloys that were produced by the electrodeposition method. The technique was by electrodepositing alloys with the compositional range of Cr/(Cr+Zn)=0–30 wt % under various manufacturing conditions and then examining the changes in the spacing of lattice planes by X-ray diffractometry. Hereinafter, the amount expressed by Cr/(Cr+Zn) in wt % shall be designated as the percent Cr content.

In the case where the percent Cr content is 0 wt %, namely, in the case of pure Zn, the η phase occurs whose crystal system is hexagonal and which has lattice constants of a=2.665 Å and c=4.947 Å. However, as the percent Cr content was increased gradually, namely, by forming a solid solution of Cr in the η phase, the crystal, which remained in the same system, extended in the direction of a axis but contracted in the direction of c axis; this observation was obtained from the changes in the spacing of lattice planes on the basis of the X-ray diffraction data. It has become clear that up to the point where the percent Cr content is 5 wt % or so, such formation of a solid solution of Cr in the η phase yields only a phase that is characterized by the continuous change in lattice constants and in which lattice constants are a=2.66–2.74 Å and c=4.61–4.95 Å. The present inventors will define this phase as η x.

As the percent Cr content is further increased, peaks in X-ray diffraction pattern will appear that can be ascribed to phases obviously different from ηx. However, the percent Cr content at which those peaks appear differs with the manufacturing conditions. By repeated calculations with the assumption of crystal system and lattice constants and by comparing the results with the spacing of lattice planes as determined from X-ray diffraction pattern, it has become clear that in addition to ηx, there also exist a phase having such a structure that the crystal system is hexagonal and that lattice constants are a=2.72–2.78 Å and c=4.43–4.60 Å (which phase is defined as the δx phase), as well as a phase having such a structure that the crystal system is cubic and that a lattice constant is a=3.00–3.06 Å (which phase is defined as the Γx phase). These results are shown in FIG. 5. The percent Cr content at which the ηx, δx and Γx phases develop differs with the manufacturing conditions and, hence, defies generalization; instead, the results obtained under several manufacturing conditions are shown in FIG. 6 as examples. As discussed above, the phase structures of electrodeposited Zn—Cr alloys would be solely composed of three phases.

In the next place, the present inventors produced Zn—Cr alloy plated steel sheets under various conditions and examined their water resistant secondary adherence of coating and the percent Cr content. It became clear that the water resistant secondary adherence of coating of the Zn—Cr alloy plated steel sheet that was substantially composed of the δx and Γx phases was outstandingly superior to that of Zn—Cr alloy plated steel sheets containing otherwise combined phases (including the case of single phases).

Thus, it has become clear that by applying a Zn—Cr alloy plating which is an alloy consisting of Zn and Cr as formed by electrodeposition and which is substantially composed of a phase having such a structure that the crystal system is hexagonal and that lattice constants are a 2.72–2.78 Å and c=4.43–4.60 Å, as well as a phase having such a structure that the crystal system is cubic and that a lattice constant is a=3.00–3.06 Å, one can obtain a Zn—Cr alloy plated steel sheet having improved water resistant secondary adherence of coating.

As already mentioned above, the range of percent Cr content for producing the Zn—Cr alloy plating that is substantially composed of the δx and Γx phases defies generalized definition since it varies with the manufacturing process but it is desirably 5–30 wt %. This is because below 5 wt %, the Γx phase will not develop whereas above 30 wt %, the adhesion of the plating layer before coatings are applied will deteriorate, which is detrimental to the effectiveness of the present invention. The coating weight of the plating is desirably 10–40 g/m$^2$ because below 10 g/m$^2$, only insufficient corrosion resistance results whereas above 40 g/m$^2$, there is no cost merit.

The manufacturing conditions for obtaining the Zn—Cr alloy plating of the present invention may be exemplified, but in no way limited, by electrodeposition from a sulfate bath which contains zinc sulfate and chromium sulfate as primary agents, sodium sulfate as an electroconductive aid, boric acid or various other organic acids as pH buffers, as well as various surfactants. Other conditions such as the pH of the bath, its temperature, the liquid flow rate and the current density for electrolysis are selected as appropriate for producing a desired phase structure. Since all of these conditions are influential on the phase structure, the alloy plating that is substantially composed of δx and Γx phases alone is obtained only in the case where those conditions are combined in an appropriate way.

It should be mentioned that when performing electroplating in practice on an industrial scale, there can be the case where phases other than the ηx and Γx phases will develop inevitably even under optimal plating conditions; however, contamination by small amounts of extraneous phases is in no way excluded as long as they are within the range over which the plating proves to be as effective as the plating that is composed of the pure ηx and Γx phase, and it should be understood that such range may be included in the definition of the expression "substantially composed of the δx and Γx phases" as used in the present invention.

The advantage of the fifth aspect of the present invention is described below on the basis of an example.

EXAMPLE 5

Table 5 lists the manufacturing conditions for inventive samples and comparative samples, the coating weight of the plating, percent Cr content and the phase structure. In all cases, SPCD (cold rolled steel sheet) with a sheet thickness of 0.7 mm was used as substrate, which was degreased and pickled in the usual manner, followed by plating to prepare samples. Each sample of the invention was substantially composed of the δx and Γx phases whereas the comparative samples comprised combinations of other phases. It should, however, be noted that those samples which contained up to about 1% of the ηx phase were considered to be substantially composed of the δx and ηx phases. Using the samples listed in Table 5, water resistant secondary adherence of coating was evaluated. The evaluation of water resistant secondary adherence of coating was conducted by the following procedure: a test specimen of 150 mm×70 mm was subjected to the chemical conversion treatment with zinc phosphate in the same manner as it was effected on ordinary automotive cold rolled steel sheets; thereafter, three-coat application was performed consisting of cationic electrodeposition coating (POWER TOP U-100 of Nippon Paint Co., Ltd.; 10 μm), intermediate coating (OTO AURORA GRAY of Kansai Paint Co., Ltd.; 40 μm) and top coating (OTO AURORA WHITE of Kansai Paint Co., Ltd.; 40 μm); the coated sample was sealed on both the back surface and the end faces, immersed in pure water at 50° C. for 10 days, recovered from the water and immediately subjected to a cross cut adhesion test; the result was evaluated by visual check. The results are shown in FIG. 11.

Figure 11:
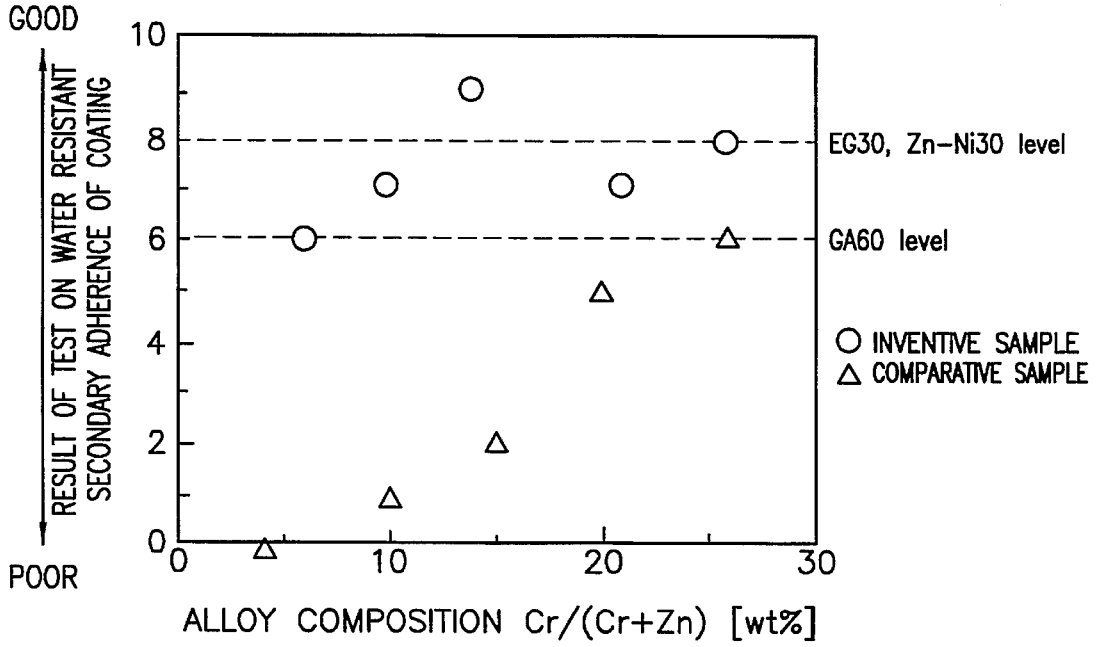
FIG. 11 is a diagram showing the results of a test conducted on Zn—Cr alloy plated steel sheets to evaluate their water resistant secondary adherence of coating.

As one can see from FIG. 11, the water resistant secondary adherence of coating of the Zn—Cr alloy plated steel sheets that satisfied the conditions of the present invention was improved over the comparative samples, to levels almost comparale to that commercial GA 60, EG 30 and Zn—Ni 30.

TABLE 5

Manufacturing Conditions for Samples of the Invention and Comparative Samples, Coating Weight of the Plating and Alloy Composition

| | Manufacturing Conditions | | | | | | |
|---|---|---|---|---|---|---|---|
| | | | | pH buffer | | Surfactant | |
| Symbol | Zinc sulfate (mol/L) | Chromium sulfate (mol/L) | Sodium sulfate (mol/L) | chemical's name | concentration (mol/L) | chemical's name | concentration (g/L) |
| Inventive sample 1 | 1.0 | 0.4 | 0.5 | malic acid Na | 0.5 | acetylene glycol | 1 |
| Inventive sample 2 | 0.6 | 0.8 | 0.5 | formic acid Na | 0.6 | acetylene glycol | 1 |

TABLE 5-continued

Manufacturing Conditions for Samples of the Invention and Comparative Samples, Coating Weight of the Plating and Alloy Composition

| | | | | | | | |
|---|---|---|---|---|---|---|---|
| Inventive sample 3 | 1.3 | 0.5 | 0.5 | none | none | acetylene glycol | 1 |
| Inventive sample 4 | 1.5 | 0.5 | 0.5 | formic acid Na | 1.0 | acetylene glycol | 1 |
| Inventive sample 5 | 0.8 | 0.5 | 0.5 | malic acid Na | 0.5 | acetylene glycol | 2 |
| Comparative sample 1 | 1.0 | 0.8 | 0.5 | none | none | polyethylene glycol | 1 |
| Comparative sample 2 | 0.8 | 0.6 | 0.5 | none | none | polyethylene glycol | 1 |
| Comparative sample 3 | 1.0 | 0.4 | 0.5 | none | none | polyethylene glycol | 1 |
| Comparative sample 4 | 1.0 | 0.6 | 0.5 | none | none | polyethylene glycol | 1 |
| Comparative sample 5 | 0.8 | 0.5 | 0.5 | tartaric acid Na | 0.6 | polyamine | 1 |

| | Manufacturing Conditions | | | | | | |
|---|---|---|---|---|---|---|---|
| Symbol | Bath temperature (°C.) | pH | Flow rate of plating solution (mps) | Current density (A/dm$^2$) | Coating weight Zn + Cr (g/m$^2$) | Percent Cr content Cr/(Cr + Zn) (wt %) | Phase structure |
| Inventive sample 1 | 50 | 1.6 | 1 | 80 | 20 | 10 | δx + Γx |
| Inventive sample 2 | 50 | 1.6 | 1 | 100 | 20 | 14 | δx + Γx |
| Inventive sample 3 | 50 | 1.3 | 2 | 80 | 20 | 6 | δx + Γx |
| Inventive sample 4 | 50 | 1.5 | 1 | 60 | 20 | 21 | δx + Γx |
| Inventive sample 5 | 50 | 1.5 | 1 | 90 | 20 | 26 | δx + Γx |
| Comparative sample 1 | 50 | 1.6 | 1 | 50 | 20 | 4 | ηx |
| Comparative sample 2 | 50 | 1.6 | 1 | 80 | 20 | 10 | ηx + δx |
| Comparative sample 3 | 50 | 1.6 | 1 | 60 | 20 | 26 | Γx |
| Comparative sample 4 | 50 | 1.7 | 1 | 40 | 20 | 20 | ηx + δx + Γx |
| Comparative sample 5 | 50 | 1.6 | 1 | 100 | 20 | 15 | δx |

INDUSTRIAL APPLICABILITY

As described above, the present invention provides a corrosion resistant steel sheet for use on automobiles and the like which is improved not only in corrosion resistance but also in water resistant secondary adherence of coating.

(F) Sixth aspect (ηx+δx+Γx phase, perforation corrosion resistance)

Concerning conventional Zn—Cr binary alloys that form alloys which are stable at thermal equilibrium state, there has been reported a phase (θ phase) having such a structure that the crystal system is hexagonal and that lattice constants are a=12.89 Å and c=30.5 Å. See, for example, the equilibrium phase diagram shown in M. Hansen, Constitution of binary alloys, p. 571, McGRAW-HILL. The formula of the θ phase is not completely clear but it is to lie within the range of Cr/(Cr+Zn)=3.8–7 wt %. Other alloys have not been reported. Thus, as regards Zn—Cr binary alloys at thermal equilibrium state, only three phases, (1) the η phases of Zn, (2) θ phase, and (3) Cr phase, are held to exist.

In this connection, it should be noted that alloys that are generally formed by electrodeposition will not always produce a thermodynamically stable phase but a non-equilibrium phase can in some cases be produced. It should further be mentioned that various phases could develop depending on manufacturing conditions such as the formula of a plating bath, conditions for electrolysis. Hence, given the same alloy formula, different phase structures could in some cases occur. The present inventors have the opinion that there is correlation between the perforation corrosion resistance and the phase structure. Hence, the inventors contemplated that plating layers having improved perforation corrosion resistance would be produced by specifying the phase structures using effectively the characteristic features of the electrodeposition method.

As for the Zn—Cr binary alloys, there have been no reported cases of alloys of such non-equilibrium phase, still less the data of JCPDS cards. Under the circumstances, the present inventors investigated in detail the phase structures of Zn—Cr alloys that were produced by the electrodeposition method. The technique was by electrodepositing alloys with the compositional range of Cr/(Cr+Zn)=0–30 wt % under various manufacturing conditions and then examining the changes in the spacing of lattice planes by X-ray diffractometry. Hereinafter, the amount expressed by Cr/(Cr+Zn) in wt % shall be designated as the percent Cr content.

In the case where the percent Cr content is 0 wt %, namely, in the case of pure Zn, the η phase occurs whose crystal system is hexagonal and which has lattice constants of a=2.665Å and c=4.947 Å. However, as the percent Cr content was increased gradually, namely, by forming a solid solution of Cr in the η phase, the crystal, which remained in the same system, extended in the direction of a axis but contracted in the direction of c axis; this observation was obtained from the changes in the spacing of lattice planes on the basis of the X-ray diffraction data. It has become clear that up to the point where the percent Cr content is 5 wt % or so, such formation of a solid solution of Cr in the η phase yields only a phase that is characterized by the continuous change in lattice constants and in which lattice constants are a=2.66–2.74 Å and c=4.61–4.95 Å. The present inventors will define this phase as ηx.

As the percent Cr content is further increased, peaks in X-ray diffraction pattern will appear that can be ascribed to phases obviously different from ηx. However, the percent Cr content at which those peaks appear differs with the manufacturing conditions. By repeated calculations with the assumption of crystal system and lattice constants and by comparing the results with the spacing of lattice planes as determined from X-ray diffraction pattern, it has become clear that in addition to ηx, there also exist a phase having such a structure that the crystal system is hexagonal and that lattice constants are a=2.72–2.78 Å and c=4.43–4.60 Å (which phase is defined as the δx phase), as well as a phase having such a structure that the crystal system is cubic and that a lattice constant is a=3.00–3.06 Å (which phase is defined as the Γx phase). These results are shown in FIG. 5. The percent Cr content at which the ηx, δx and Γx phases develop differs with the manufacturing conditions and, hence, defies generalization; instead, the results obtained under several manufacturing conditions are shown in FIG. 6 as examples. As discussed above, the phase structures of electrodeposited Zn—Cr alloys would be solely composed of three phases.

In the next place, the present inventors produced Zn—Cr alloy plated steel sheets under various conditions and examined the relationship between their perforation corrosion resistance and the percent Cr content. It became clear that the perforation corrosion resistance of the Zn—Cr alloy plated steel sheet that was substantially composed of the ηx, δx and Γx phases was outstandingly superior to that Zn—Cr alloy plated steel sheets composed of single phases or the combinations of two phases.

Thus, it has become clear that by applying a Zn—Cr alloy plating which is an alloy consisting of Zn and Cr as formed by electrodeposition and which is substantially composed of a phase having such a structure that the crystal system is hexagonal and that lattice constants are a=2.66–2.74 Å and c=4.61–4.95 Å, and a phase having such a structure that the crystal system is hexagonal and that lattice constants are a=2.72–2.78 Å and c=4.43–4.60 Å, as well as a phase having such a structure that the crystal system is cubic and that a lattice constant is a=3.00–3.06 Å, one can obtain a Zn—Cr alloy plated steel sheet having improved perforation corrosion resistance.

As already mentioned above, the range of percent Cr content for producing the Zn—Cr alloy plating that is substantially composed of the ηx, δx and Γx phases defies generalized definition since it varies with the manufacturing process but it is desirably 5–30 wt %. This is because below 5 wt %, the δx or Γx phase will not develop whereas above 30 wt %, the adhesion of the plating layer before coatings are applied will deteriorate, which is detrimental to the effectiveness of the present invention. The coating weight of the plating is desirably 10–40 g/m$^2$ because below 10 g/m$^2$, only insufficient corrosion resistance results whereas above 40 g/m$^2$, there is no cost merit.

The manufacturing conditions for obtaining the Zn—Cr alloy plating of the present invention may be exemplified, but in no way limited, by electrodeposition from a sulfate bath which contains zinc sulfate and chromium sulfate as primary agents, sodium sulfate as an electroconductive aid, boric acid or various other organic acids as pH buffers, as well as various surfactants. Other conditions such as the pH of the bath, its temperature, the liquid flow rate and the current density for electrolysis are selected as appropriate for producing a desired phase structure. Since all of these conditions are influential on the phase structure, the alloy plating that is substantially composed of ηx, δx and Γx phases alone is obtained only in the case where those conditions are combined in an appropriate way.

It should be mentioned that when performing electroplating in practice on an industrial scale, there can be the case where phases other than the ηx, δx and Γx phases will develop inevitably even under optimal plating conditions; however, contamination by small amounts of extraneous phases is in no way excluded as long as they are within the range over which the plating proves to be as effective as the plating that is composed of the ηx phase, δx phase and Γx phase, and it should be understood that such range may be included in the definition of the expression "substantially composed of the ηx, δx and Γx phases" as used in the present invention.

The advantage of the sixth aspect of the present invention is described below on the basis of an example.

EXAMPLE 6

Figure 12:
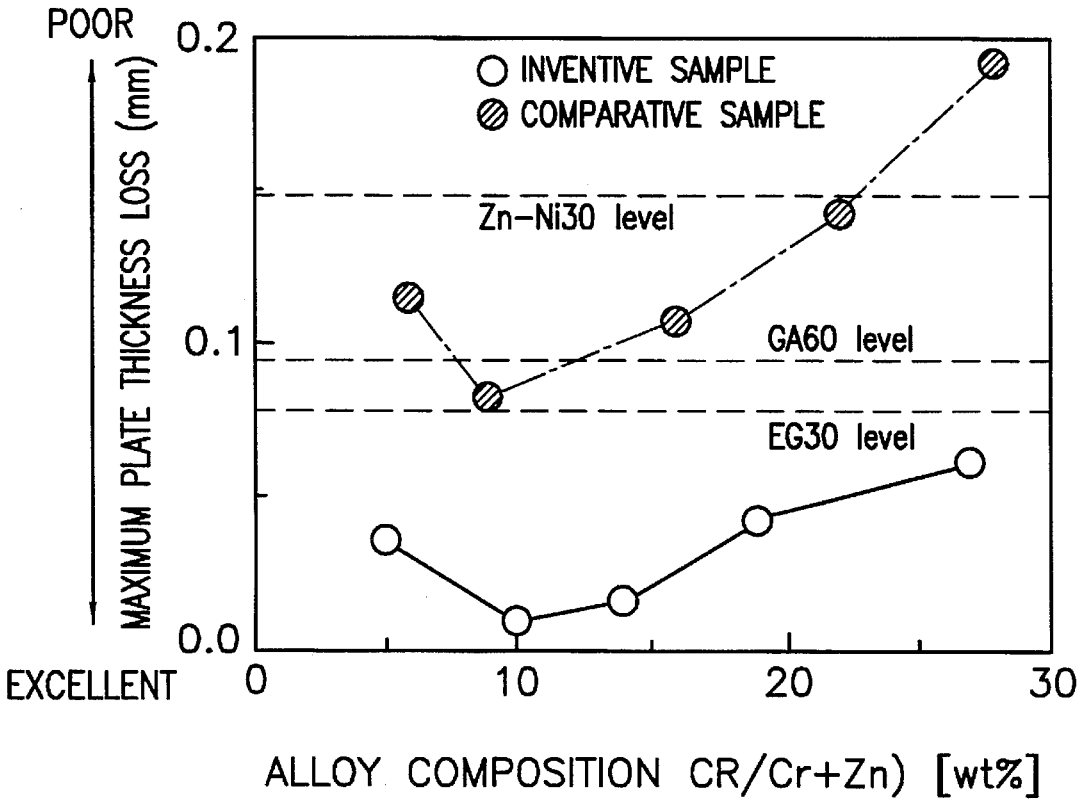
FIG. 12 is a diagram showing the relationship between the perforation corrosion resistance of Zn—Cr alloy plated steel sheets and the alloy composition.

Table 6 lists the manufacturing conditions for inventive samples and comparative samples, the coating weight of the plating, percent Cr content and the phase structure. In all cases, SPCD (cold rolled steel sheet) with a sheet thickness of 0.7 mm was used as substrate, which was degreased and pickled in the usual manner, followed by plating to prepare samples. Each sample of the invention was substantially composed of the ηx, δx and Γx phases whereas the comparative samples comprised single phases or combinations of two phases. Using the samples listed in Table 6, perforation corrosion resistance was evaluated. The evaluation of perforation corrosion resistance was conducted by the following procedure: a test specimen of 150 mm×70 mm was subjected to the chemical conversion treatment with zinc phosphate in the same manner as it was effected on ordinary automotive cold rolled steel sheets; thereafter, cationic electrodeposition coating (POWER TOP U-100 of Nippon Paint Co., Ltd.; 20 μm) was applied and the sample was scribed to the substrate with a cutter knife; the specimen was then exposed for one month to a corrosive environment (for the test cycles used, see FIG. 3) using cyclic corrosion test; thereafter, the maximum sheet thickness loss around the scribe was measured. As one can see from FIG. 12, the perforation corrosion resistance of the Zn—Cr alloy plated steel sheets that satisfied the conditions of the present invention is superior not only over the comparative samples but also over EG 30, Zn—Ni 30 and GA 60.

TABLE 6

| Symbol | Manufacturing Conditions | | | | | | |
|---|---|---|---|---|---|---|---|
| | | | | pH buffer | | Surfactant | |
| | Zinc sulfate (mol/L) | Chromium sulfate (mol/L) | Sodium sulfate (mol/L) | chemical's name | concentration (mol/L) | chemical's name | concentration (g/L) |
| Inventive sample 1 | 1.0 | 0.5 | 0.5 | boric acid Na | 0.6 | acetylene glycol | 1 |
| Inventive sample 2 | 0.7 | 0.6 | 0.5 | citric acid Na | 0.5 | acetylene glycol | 1 |
| Inventive sample 3 | 1.2 | 0.5 | 0.6 | none | none | acetylene glycol | 1 |
| Inventive sample 4 | 1.4 | 0.4 | 0.5 | boric acid Na | 0.5 | acetylene glycol | 1 |
| Inventive sample 5 | 0.9 | 0.6 | 0.5 | citric acid Na | 0.5 | acetylene glycol | 1 |
| Comparative sample 1 | 0.6 | 0.4 | 0.5 | none | none | polyethylene glycol | 1 |
| Comparative sample 2 | 0.8 | 0.5 | 0.5 | formic acid Na | 0.6 | polyethylene glycol | 1 |
| Comparative sample 3 | 1.0 | 0.4 | 0.5 | none | none | polyethylene glycol | 1 |
| Comparative sample 4 | 1.0 | 0.6 | 0.5 | none | none | polyamine | 1 |
| Comparative sample 5 | 0.8 | 0.5 | 0.5 | none | none | polyethylene glycol | 1 |

| Symbol | Manufacturing Conditions | | | | | | |
|---|---|---|---|---|---|---|---|
| | Bath temperature (°C.) | pH | Flow rate of plating solution (mps) | Current density (A/dm$^2$) | Coating weight Zn + Cr (g/m$^2$) | Percent Cr content Cr/(Cr + Zn) (wt %) | Phase structure |
| Inventive sample 1 | 50 | 1.5 | 1 | 70 | 20 | 14 | ηx + δx + Γx |
| Inventive sample 2 | 50 | 1.6 | 2 | 100 | 20 | 10 | ηx + δx + Γx |
| Inventive sample 3 | 50 | 1.4 | 1 | 80 | 20 | 5 | ηx + δx + Γx |
| Inventive sample 4 | 50 | 1.5 | 1 | 50 | 20 | 19 | ηx + δx + Γx |
| Inventive sample 5 | 50 | 1.5 | 1 | 50 | 20 | 27 | ηx + δx + Γx |
| Comparative sample 1 | 50 | 1.6 | 1 | 50 | 20 | 28 | Γx |
| Comparative sample 2 | 50 | 1.5 | 1 | 70 | 20 | 22 | δx + Γx |
| Comparative sample 3 | 50 | 1.6 | 1 | 100 | 20 | 6 | ηx |
| Comparative sample 4 | 50 | 1.7 | 1 | 50 | 20 | 9 | ηx + δx |
| Comparative sample 5 | 50 | 1.5 | 2 | 80 | 20 | 16 | δx |

INDUSTRIAL APPLICABILITY

As described above, the present invention provides a corrosion resistant steel sheet for use on automobiles and the like that has improved perforation corrosion resistance.

We claim:

1. A corrosion resistant steel sheet having improved resistances to corrosion and cosmetic corrosion that is treated with a Zn—Cr alloy plating which is an alloy consisting of Zn and Cr as formed by electrodeposition and which is substantially solely composed of a phase ηx having a hexagonal crystal system with lattice constants a=2.66–2.74 Å and c=4.61–4.95 Å, and any portion of said alloy not composed of said ηx phase is substantially composed of at least one phase selected from the group consisting of a phase Γx having a cubic crystal system with a lattice constant a=3.00–3.06 Å, and a phase δx having a hexagonal crystal system with lattice constants a=2.72–2.78 Å and c=4.43–4.60 Å.

2. The sheet defined in claim 1 wherein said ηx phase is at least 99% of said alloy, and up to 1% of said alloy is at least one phase selected from the group consisting of said Γx phase and said δx phase.

3. A corrosion resistant steel sheet having improved corrosion resistance and formability that is treated with a Zn—Cr alloy plating which is an alloy consisting of Zn and Cr as formed by electrodeposition and which is substantially solely composed of a phase Γx having a cubic crystal system with a lattice constant a=3.00–3.06 Å, and any portion of said alloy not composed of said phase is substantially composed of at least one phase selected from the group consisting of a phase ηx having a hexagonal crystal system with lattice constants a=2.66–2.74 Å and c=4.61–4.95 Å, and a phase δx having a hexagonal system with lattice constants a=2.72–2.78 Å and c=4.43–4.60 Å.

4. The sheet defined in claim 3 wherein said Γx phase is at least 99% of said alloy, and up to 1% of said alloy is at least one phase selected from the group consisting of said δx phase and said ηx phase.

5. A corrosion resistant steel sheet having improved resistances to corrosion and chipping that is treated with a Zn—Cr alloy plating which is an alloy consisting of Zn and Cr as formed by electrodeposition and which is substantially composed of a phase ηx having a hexagonal crystal system and lattice constants a=2.66–2.74 Å and c=4.61–4.95 Å, as well as a phase δx having a hexagonal crystal system and lattice constants a=2.72–2.78 Å and c=4.43–4.60 Å, and any portion of said alloy not composed of said phase is substantially composed of a phase Γx having a cubic crystal system with a lattice constant of a=3.00–3.06 Å.

6. The sheet defined in claim 5 wherein said ηx and δx phases are at least 99% of said alloy, and up to 1% of said alloy is said Γx phase.

7. A corrosion resistant steel sheet having improved corrosion resistance both before and after forming that is treated with a Zn—Cr alloy plating which is an alloy consisting of Zn and Cr as formed by electrodeposition and which is substantially composed of a phase ηx having a hexagonal crystal system and lattice constants a=2.66–2.74 Å and c=4.61–4.95 Å, as well as a phase Γx having cubic crystal system and a lattice constant a=3.00–3.06 Å, and any portion of said alloy not composed of said phases is substantially composed of a phase δx having a hexagonal crystal structure with lattice constants a=2.72–2.78 Å and c=4.43–4.60 Å.

8. The sheet defined in claim 7 wherein said ηx and Γx phases are at least 99% of said alloy, and up to 1% of said alloy is said δx phase.

9. A corrosion resistant steel sheet having improved corrosion resistance and water resistant secondary adherence of coating that is treated with a Zn—Cr alloy plating which is an alloy consisting of Zn and Cr as formed by electrodeposition and which is substantially composed of a phase δx having a hexagonal crystal system and lattice constants a=2.72–2.78 Å and c=4.43–4.60 Å, as well as a phase Γx having a cube crystal system and a lattice constant a=3.00–3.06 Å, and any portion of said alloy not composed of said phases is substantially composed of a phase ηx having a hexagonal crystal structure with lattice constants a=2.66–2.74 Å and c=4.61–4.95 Å.

10. The sheet defined in claim 9 wherein said δx and Γx phases are at least 99% of said alloy, and up to 1% of said alloy is said ηx phase.

11. A corrosion resistant steel sheet having improved resistances to corrosion and perforation corrosion that is treated with a Zn—Cr alloy plating which is an alloy consisting of Zn and Cr as formed by electrodeposition and which is substantially solely composed of a phase ηx having a hexagonal crystal system with lattice constants a=2.66–2.74 Å and c=4.61–4.95 Å, and a phase δx having a hexagonal crystal system with lattice constants a=2.72–2.78 Å and c=4.43–4.60 Å, as well as a phase Γx having a cubic crystal system with lattice constant a=3.00–3.06 Å.

* * * * *

UNITED STATES PATENT AND TRADEMARK OFFICE

CERTIFICATE OF CORRECTION

PATENT NO. : 5,510,196

DATED : April 23, 1996

INVENTOR(S) : Hiroki Nakamaru, Tohru Fujimura, Hiroaki Ohnuma, Kazuo Mochizuki, Nobuyuki Morito & Michio Katayama It is certified that error appears in the above-indentified patent and that said Letters Patent is hereby corrected as shown below:

In Column 4, line 45, please change "Of" to --of--.

In Column 7, line 54, please change "phase," to --η phase,--; and
line 56, please change "a axis" to --a axis-- and change "of c" to --of c--.

In Column 11, line 65, please change "a axis" to --a axis-- and change "of c" to --of c--.

In Column 14, line 14, please change "g/m2)," to --g/m$^2$),--.

In Column 17, line 32, please change "a axis" to --a axis-- and change "of c" to --of c--.

In Column 21, line 52, please change "a axis" to --a axis--; and
line 53, please change "of c" to --of c--.

In Column 26, line 42, please change "a axis" to --a axis--; and
line 43, please change "of c" to --of c--.

In Column 28, line 3, please change "ηx" to --δx--; and
line 8, please change "ηx" to --δx--.

UNITED STATES PATENT AND TRADEMARK OFFICE

CERTIFICATE OF CORRECTION

PATENT NO. : 5,510,196

DATED : April 23, 1996

INVENTOR(S) : Hiroki Nakamaru, Tohru Fujimura, Hiroaki Ohnuma, Kazuo Mochizuki, Nobuyuki Morito & Michio Katayama It is certified that error appears in the above-indentified patent and that said Letters Patent is hereby corrected as shown below:

In Column 31, line 3, please change "a axis" to --a axis--; and
line 4, please change "of c" to --of c--.

Signed and Sealed this

Fifteenth Day of April, 1997

Bruce Lehman

*Attest:*

BRUCE LEHMAN

*Attesting Officer*

*Commissioner of Patents and Trademarks*